US012546049B2

(12) United States Patent
Choi et al.

(10) Patent No.: US 12,546,049 B2
(45) Date of Patent: Feb. 10, 2026

(54) WASHING MACHINE

(71) Applicant: LG Electronics Inc., Seoul (KR)

(72) Inventors: Jaehyun Choi, Seoul (KR); Yohwan Kang, Seoul (KR); Hyunjae Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 211 days.

(21) Appl. No.: 18/141,669

(22) Filed: May 1, 2023

(65) Prior Publication Data

US 2023/0265594 A1 Aug. 24, 2023

Related U.S. Application Data

(62) Division of application No. 16/455,220, filed on Jun. 27, 2019, now Pat. No. 11,692,296.

(30) Foreign Application Priority Data

Jun. 27, 2018 (KR) ..... 10-2018-0073911
Jun. 25, 2019 (KR) ..... 10-2019-0075431
Jun. 25, 2019 (KR) ..... 10-2019-0075432

(51) Int. Cl.
*D06F 37/26* (2006.01)
*D06F 37/04* (2006.01)
*D06F 39/08* (2006.01)

(52) U.S. Cl.
CPC ..... *D06F 37/266* (2013.01); *D06F 37/04* (2013.01); *D06F 39/083* (2013.01); *D06F 39/088* (2013.01); *D06F 39/085* (2013.01)

(58) Field of Classification Search
CPC ..... D06F 37/266; D06F 39/083
See application file for complete search history.

(56) References Cited

U.S. PATENT DOCUMENTS

2012/0167639 A1* 7/2012 Kikukawa ..... D06F 23/025 68/141
2014/0033449 A1 2/2014 Im et al.
2014/0352363 A1 12/2014 Kim

FOREIGN PATENT DOCUMENTS

| | | |
|---|---|---|
| AU | 2018260951 | 5/2019 |
| CN | 2372345 | 4/2000 |
| CN | 101925699 | 12/2010 |
| CN | 102121186 | 7/2011 |
| CN | 102418257 | 4/2012 |

(Continued)

OTHER PUBLICATIONS

CN Office Action in Chinese Appln. No. 201910566685.9, dated Jan. 28, 2021, 12 pages (with English translation).

(Continued)

*Primary Examiner* — Spencer E. Bell
(74) *Attorney, Agent, or Firm* — Fish & Richardson P.C.

(57) ABSTRACT

A washing machine includes a casing, a tub, a drum, a pump for circulating water from the tub, a gasket connecting an entry hole of the casing to an entrance hole of the tub and including nozzles for spraying water to the drum, and outlet ports for supplying water to the nozzles. The nozzles are arranged at an inner surface of the gasket at both lateral sides of the gasket in a vertical direction. The gasket includes port receiving pipes that receive the outlet ports, respectively, that are arranged in the vertical direction at an outer surface of the gasket, and that extend parallel to each other.

20 Claims, 17 Drawing Sheets

(56) References Cited

FOREIGN PATENT DOCUMENTS

| | | | |
|---|---|---|---|
| CN | 102575412 | | 7/2012 |
| CN | 102597354 | | 7/2012 |
| CN | 103119212 | | 5/2013 |
| CN | 103147254 | | 6/2013 |
| CN | 103547724 | | 1/2014 |
| CN | 103797174 | | 5/2014 |
| CN | 104213372 | | 12/2014 |
| CN | 104233694 | | 12/2014 |
| CN | 104919108 | | 9/2015 |
| CN | 105780383 | | 7/2016 |
| EA | 017938 | | 4/2013 |
| EP | 2634303 | | 9/2013 |
| EP | 2719814 | | 4/2014 |
| EP | 3483329 | | 5/2019 |
| JP | 2001-070694 | A | 3/2001 |
| JP | 2011139815 | | 7/2011 |
| JP | 2011-250920 | A | 12/2011 |
| JP | 2012070810 | | 4/2012 |
| JP | 2014-045932 | A | 3/2014 |
| KR | 10-2011-0040179 | | 4/2011 |
| KR | 10-2011-0040180 | A | 4/2011 |
| KR | 10-2014-0140435 | | 12/2014 |
| KR | 10-2018-0131894 | | 12/2018 |
| WO | WO 2011024409 | A1 | 3/2011 |
| WO | WO 2016136154 | | 9/2016 |

OTHER PUBLICATIONS

Extended European Search Report in European Application No. 19182776.5, dated Nov. 8, 2019, 9 pages.
Office Action in Chinese Appln. No. 202210311707.9, dated Mar. 16, 2023, 14 pages (with English translation).
Office Action in Japanese Appln. No. 2020-572501, dated Feb. 8, 2022, 10 pages (with English translation).
Office Action in Russian Appln. No. 2021101568/03, dated Jun. 29, 2021, 13 pages (with English abstract).
PCT International Search Report in International Application No. PCT/KR2019/007669, dated Oct. 24, 2019, 5 pages.
Notice of Allowance in Korean Appln. No. 10-2018-0168035, mailed on Jan. 10, 2024, 4 pages (with English translation).
Office Action in Australian Appln. No. 2023200302, mailed on Feb. 22, 2024, 5 pages.
Office Action in Korean Appln. No. 10-2019-0075431, mailed on Jun. 17, 2024, 13 pages (with English translation).
Office Action in Japanese Appin. No. 2023-000508, mailed on Jun. 24, 2025, 5 pages (with English translation).

* cited by examiner

WASHING MACHINE

CROSS-REFERENCE TO RELATED APPLICATIONS

This application is a division of U.S. Application Ser. No. 16/455,220, filed on Jun. 27, 2019, which claims the priority benefit of Korean Application No. 10-2019-0075432, filed on Jun. 25, 2019, Korean Application No. 10-2019-0075431, filed on Jun. 25, 2019, and Korean Application No. 10-2018-0073911, filed on Jun. 27, 2018. The disclosures of the prior applications are incorporated by reference in their entirety.

BACKGROUND OF THE INVENTION

1. Field of the Invention

The present invention relates to a washing machine and particularly to a washing machine in which a nozzle for spraying circulating water into a drum is disposed at a gasket.

2. Description of the Related Art

Korean Patent Application Publication No. 10-2018-0131894 (hereinafter, referred to as a "related art") discloses a washing machine having nozzles for spraying circulation water, pumped by a pump, into a drum. In the washing machine, a plurality of nozzles are provided along an inner circumferential surface of a gasket disposed between a casing forming an exterior appearance of the washing machine and a tub containing water, and a plurality of port receiving pipes communicates with the plurality of nozzles, respectively.

There is a guide pipe that guides water (circulating water) pumped by the pump. In the guide pipe, a plurality of outlet port protruding from an annular flow path is inserted into the plurality of port receiving pipes.

Each of the port receiving pipes protrude from an outer circumferential surface of a gasket approximately toward an outer side of a radial direction, and, in response, each of the outlet ports protrude from the annular flow path to an inner side of the radial direction.

As such, in order to fabricate the gasket in a shape in which the port receiving pipes extend radially, a mold needs to move in a direction in which each of the port receiving pipes extends, and thus, a complicated structure is required for the mold.

In addition, since the outlet ports are inserted into the port receiving pipes in different directions, it is not possible to assemble two or more nozzle water supply ports to two or more port receiving pipes, and thus, a complicated fabricating process is required.

SUMMARY OF THE INVENTION

A first object of the present invention is to provide a washing machine which includes a plurality of nozzles provided on a gasket to spray circulating water into a drum, and which has a structure that allows the gasket to be easily molded by an injection technique.

A second object of the present invention is to provide a washing machine having two or more nozzles on the left and right sides of the gasket are provided, wherein water supply ports for supplying circulating water to the nozzles are formed integrally with the gasket.

A third object of the present invention is to provide a washing machine having the port receiving pipes disposed parallel to each other.

A fourth object of the present invention is to provide a washing machine that allows distribution pipes, which supplies circulating water to the nozzles, to be easily assembled to the gasket.

Objects of the present invention should not be limited to the aforementioned objects and other unmentioned objects will be clearly understood by those skilled in the art from the following description.

In the washing machine of the present invention, a wash water is discharged from a tub accommodating a rotating drum, pumped by a pump, and supplied through a plurality of outlet ports to a plurality of nozzles disposed in a gasket.

The gasket includes a gasket body forming a passage connecting an entry hole formed in a casing and an entrance hole of the tub, and a plurality of nozzles is provided on an inner circumferential surface of the gasket. In addition, the gasket further includes a plurality of a plurality of port receiving pipes communicating with the plurality of nozzles, respectively.

The plurality of outlet ports protrude from an outer circumferential surface of the gasket body and inserted into the plurality of port receiving pipes, respectively.

When the gasket body is bilaterally divided into a first area and a second area, the plurality of port receiving pipes includes a first port receiving pipe and a second port receiving pipe that are disposed in the first area in a top-to-bottom direction and parallel to each other.

The gasket may include a third port receiving pipe and a fourth port receiving pipe that are disposed in the second area in the top-to-bottom direction and parallel to each other.

The first and second port receiving pipes horizontally may extend in a first direction. The first port receiving pipe may be disposed higher than a middle height of the gasket body, and the second port receiving pipe may be disposed lower than a middle height of the gasket body.

The third and fourth port receiving pipes horizontally may extend in a direction opposite to the first direction. The third port receiving pipe may be disposed at a height equal to a height of the first port receiving pipe, and the fourth port receiving pipe may be disposed at a height equal to a height of the second port receiving pipe.

The gasket may include a casing coupling part coupled to a circumference of the entry hole, a tub coupling part coupled to a circumference of the entrance hole of the tub, and a basket body extending from the casing coupling part to the tub coupling part.

The first to fourth port receiving pipes may protrude from an outer circumferential surface of the gasket body.

The gasket body may include a rim part extending from the casing coupling part to the tub coupling part, an inner circumferential part extending from the rim part to the casing coupling part, and an outer circumferential part extending from the inner circumferential part to the tub coupling part.

The first to fourth port receiving pipes may protrude from an outer circumferential surface of the outer circumferential part.

A length of the second port receiving pipe may be smaller than a length of the first port receiving pipe. The first port receiving pipe may be disposed higher at a first distance than a middle height point of the gasket body, and the second port receiving pipe may be disposed lower at a second distance, smaller than the first distance, than the middle height point of the gasket body.

A length of the fourth port receiving pipe may be smaller than a length of the third port receiving pipe. The third port receiving pipe may be disposed higher at a first distance than a middle height point of the gasket body, and the fourth port receiving pipe may be disposed lower at a second distance, smaller than the first distance, than the middle height point of the gasket body.

The first and second port receiving pipes and the third and fourth port receiving pipes may be disposed symmetrically.

The washing machine may further include: a circulation pipe for guiding wash water discharged from the pump; and a distribution pipe fixed to the gasket to supply the wash water, guided along the circulation pipe, to the plurality of nozzles.

The distribution pipe may include an inlet port connected to the circulation pipe, and a first conduit part and a second conduit part that branch wash water supplied through the inlet port.

The plurality of outlet ports may include: a first outlet port and a second outlet port that are disposed in the first conduit part and inserted into the first and second port receiving pipes, respectively; and a third outlet port and a fourth outlet port that are disposed in the first conduit part and inserted into the third and fourth port receiving pipes, respectively The washing machine may further include: a first circulation pipe and a second circulation pipe that guide wash water discharged from the pump; a first distribution pipe fixed to the first area and guides wash water supplied through the first circulation pipe; and a second distribution pipe fixed to the second area and guides wash water supplied through the second circulation pipe.

The plurality of outlet ports may include: a first outlet port and a second outlet port that are disposed in the first distribution pipe and inserted into the first and second port receiving pipes, respectively; and a third outlet port and a fourth outlet port that are disposed in the second distribution pipe and inserted into the third and fourth port receiving pipes, respectively.

The washing machine of the present invention may have one or more effects, as below.

First, since two or more port receiving pipes integrally formed with the gasket are disposed to be parallel to each other, it is possible to perform an opening or separating operation even if the two or more nozzles are injected using a movable mold.

Second, the two or more port receiving pipes are, when seen from the front, parallelly formed in one of a first area and a second area into which the gasket is divided, and thus, if the distribution pipe is installed to the gasket, the outlet ports provided in the distribution pipe may be moved in the substantially identical direction, and therefore, the outlet ports can be inserted into the port receiving pipes at the same time and the assembling process may be performed more conveniently.

In particular, in a structure in which the distribution pipe includes a first conduit part and a second conduit part that are branched from a circulating water connection port, in which the two or more outlet ports are formed in one of the first conduit part and the second conduit part, in which the two or more outlet ports extend in a radial direction and the two or more port receiving pipes extend in the radial direction, it is difficult to insert the outlet ports into the port receiving pipes at the same time because the directions for the outlet orts to be inserted are different. However, the present invention solves this problem as the port receiving pipes (or the outlet ports) are disposed to be parallel to each other.

A washing machine according to another aspect of the present invention includes a first nozzle, a second nozzle, a third nozzle, and a fourth nozzle provided on an inner circumferential surface of the gasket body, wherein, when the gasket body is bilaterally divided into a first area and a second area, the first and second nozzles are disposed in the first area sequentially in a top-to-bottom direction and the third and fourth nozzles are disposed in the second area sequentially in the top-to-bottom direction.

The first and third nozzles are disposed higher than half a height of the gasket body to thereby spray water downward, and the second and fourth nozzles are disposed lower than half the height of the gasket body to thereby spray water upward.

The first and second nozzle may spray water toward the second area.

The third and fourth nozzles may spray water toward the first area.

Water streams sprayed through the first and second nozzles and water streams sprayed through the third and fourth nozzles may be bilaterally symmetrical.

A first spray width angle of a water stream sprayed through the first nozzle may be smaller than a spray width angle of a water stream sprayed through the second nozzle.

A difference between the second spray width angle and the first spray width angle may be between 4° and 6°. The first spray width angle may be between 38° and 42°.

The spray direction of the first nozzle may form a deviation angle upwardly relative to a line that connects the first nozzle and a center of the gasket. The deviation angle may be between 5° and 9°.

The first nozzle may be disposed between a position corresponding to an angle from a lowest point in the gasket body to the second nozzle and a highest point in the gasket body, and disposed higher than a point that equally divides the angle from the lowest point in the gasket body to the second nozzle.

A first angle between the first nozzle and the second nozzle may be greater than a second angle between a highest point in the gasket body and the first nozzle. The first angle may be between 63° and 67°.

The second nozzle may be disposed at a point corresponding to one third of the height of the gasket body.

The first nozzle may be disposed at a point higher than two thirds of the height of the gasket body.

BRIEF DESCRIPTION OF THE DRAWINGS

The embodiments will be described in detail with reference to the following drawings in which like reference numerals refer to like elements wherein.

DETAILED DESCRIPTION OF THE PREFERRED EMBODIMENTS

Figure 1:
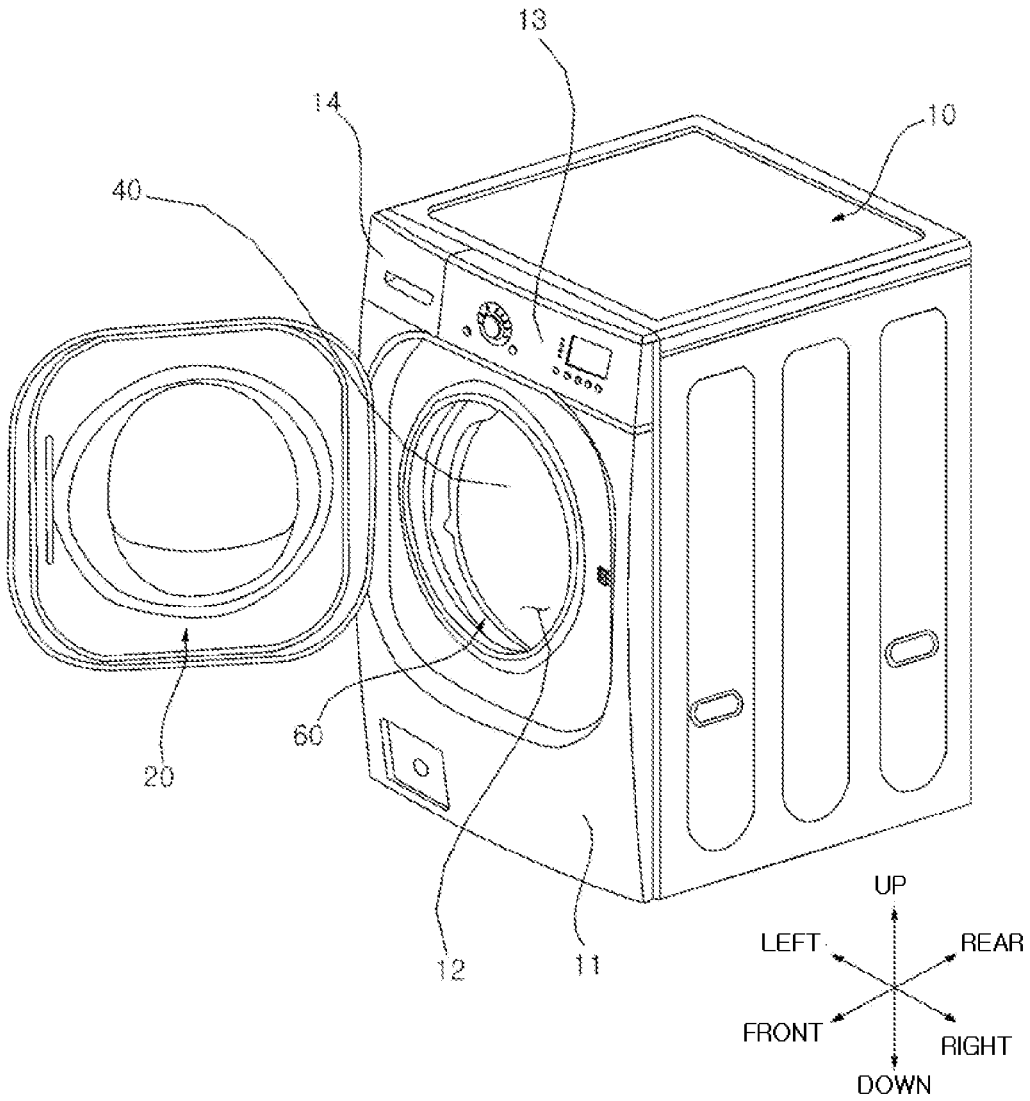
FIG. 1 is a perspective view of a washing machine according to an embodiment of the present invention.

Advantages and features of the present disclosure and methods to achieve them will become apparent from the descriptions of exemplary embodiments herein below with reference to the accompanying drawings. However, the present disclosure is not limited to exemplary embodiments disclosed herein but may be implemented in various different ways. The exemplary embodiments are provided for making the disclosure of the present disclosure thorough and for fully conveying the scope of the present disclosure to those skilled in the art. It is to be noted that the scope of the present disclosure is defined only by the claims. Like reference numerals denote like elements throughout the descriptions.

Hereinafter, the present invention will be described in detail with reference to the accompanying drawings.

Figure 2:
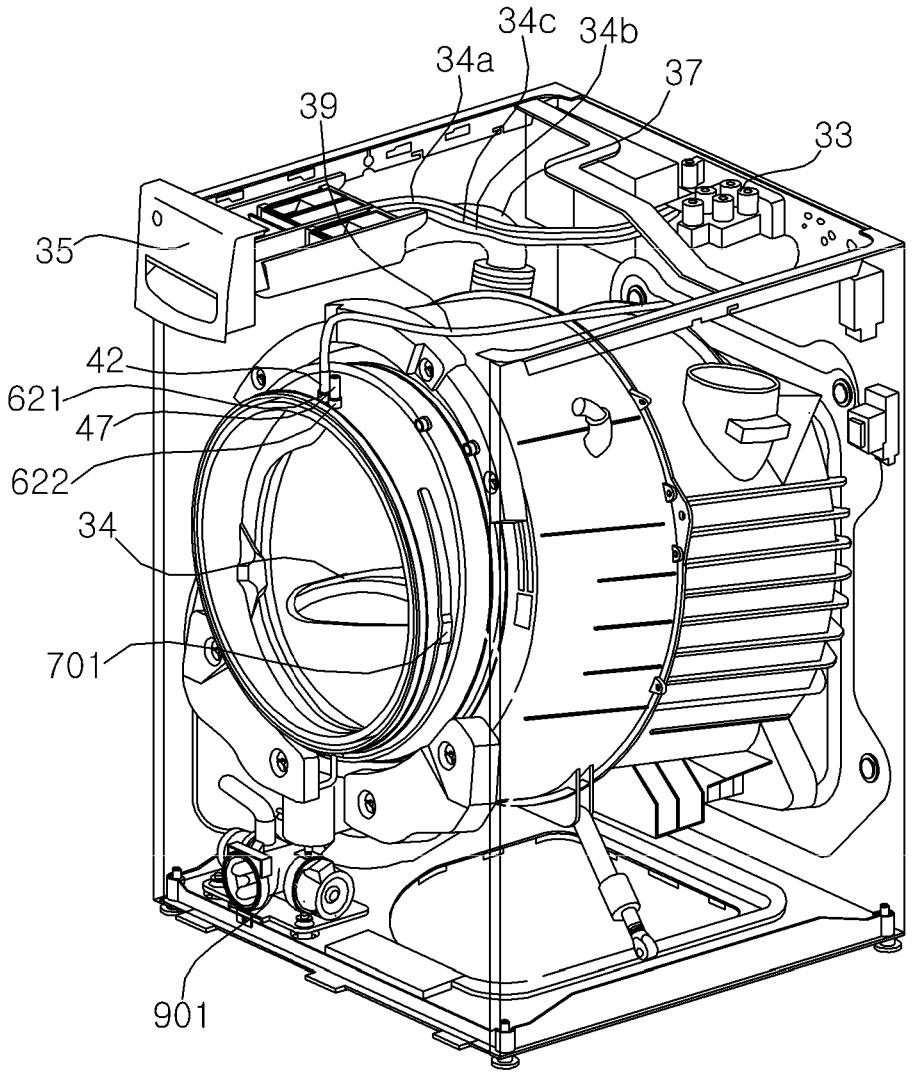
FIG. 2 is a perspective view illustrating the interior of the washing machine shown in FIG. 1.
Figure 3:
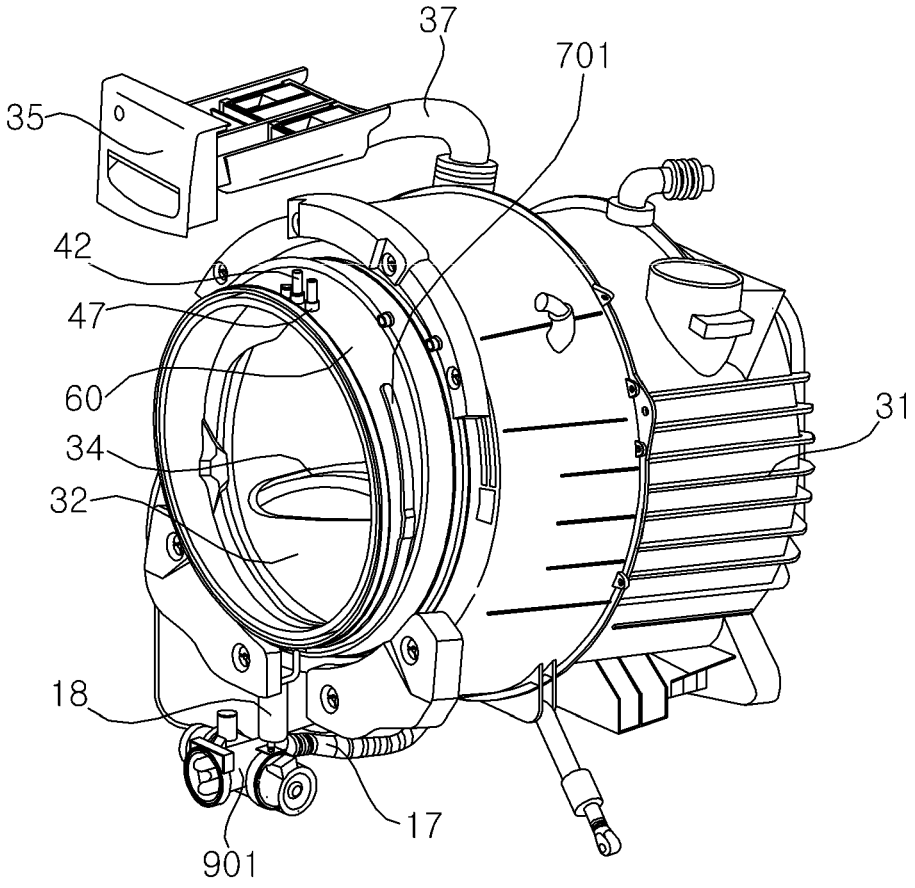
FIG. 3 is a perspective view illustrating part of the washing machine shown in FIG. 2.
Figure 4:
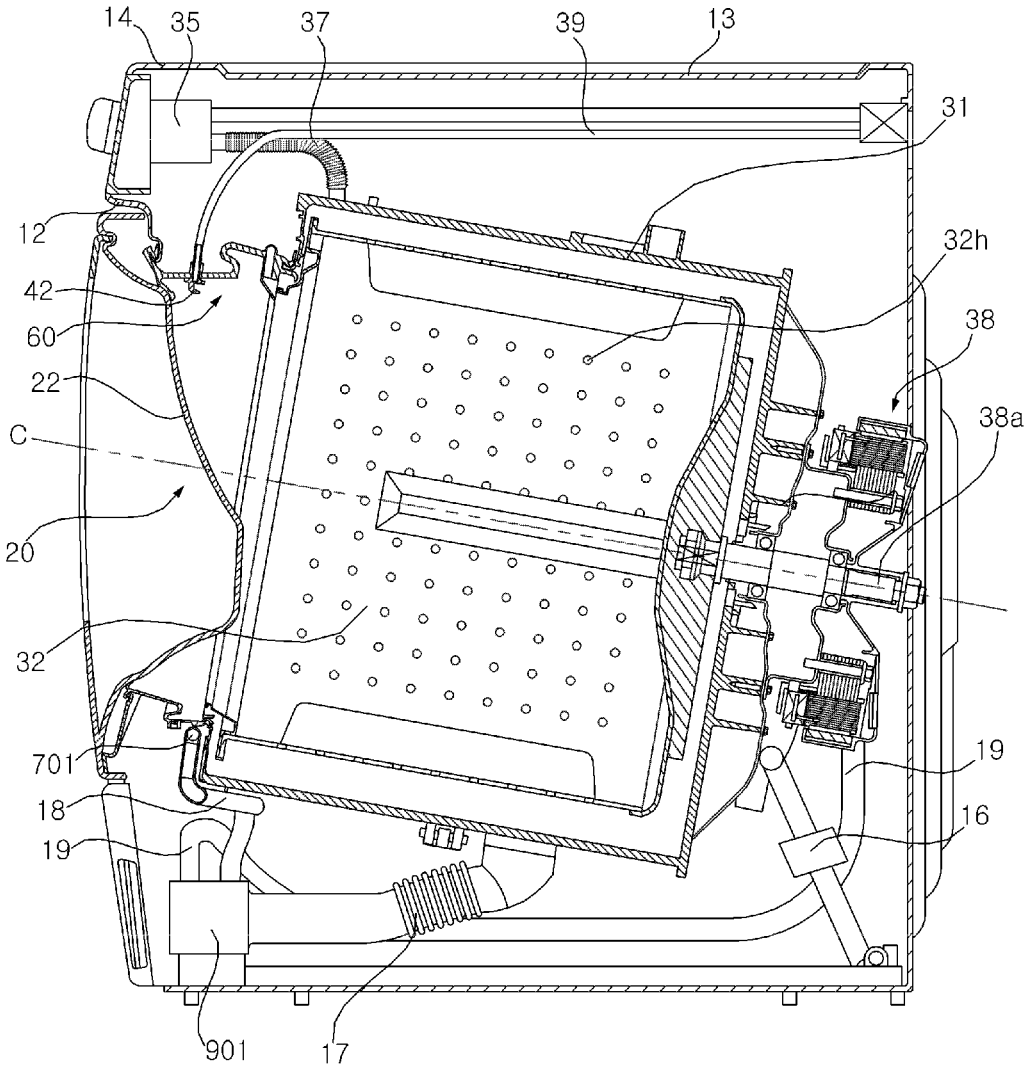
FIG. 4 is a sectional right-side view of the washing machine shown in FIG. 2.
Figure 5:
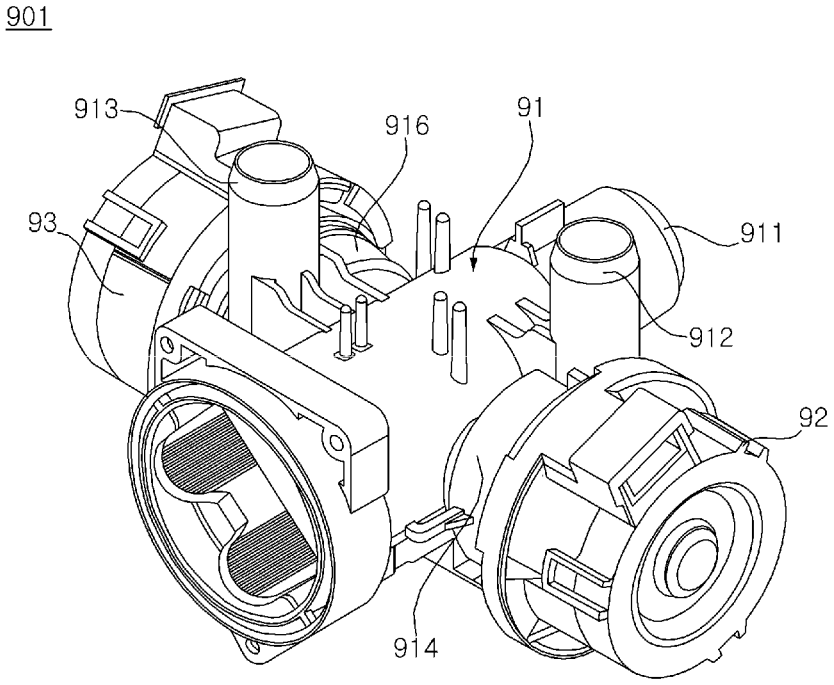
FIG. 5 is a perspective view of a pump shown in FIG. 2.
Figure 6A:
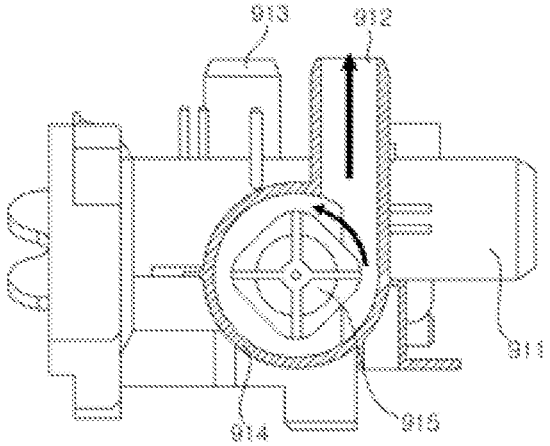
FIG. 6A is a cross-sectional view illustrating a circulating water chamber in the pump shown in FIG. 5.
Figure 6B:
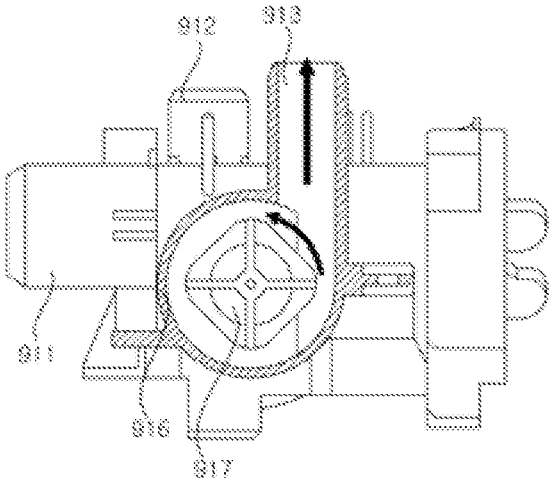
FIG. 6B is a cross-sectional view illustrating a drain chamber of the pump shown in FIG. 5.

FIG. 1 is a perspective view of a washing machine according to an embodiment of the present invention. FIG. 2 is a perspective view illustrating the interior of the washing machine shown in FIG. 1. FIG. 3 is a perspective view illustrating part of the washing machine shown in FIG. 2. FIG. 4 is a sectional right-side view of the washing machine shown in FIG. 2. FIG. 5 is a perspective view of a pump shown in FIG. 2. FIG. 6A is a cross-sectional view illustrating a circulating water chamber in the pump shown in FIG. 5, and FIG. 6B is a cross-sectional view illustrating a drain chamber of the pump shown in FIG. 5.

Referring to FIGS. 1 to 6B, a casing 10 forms an exterior appearance of a washing machine, and an entry hole 12*h* through which laundry is introduced is formed on a front surface of the casing 10. The casing 10 may include a cabinet 11 having an open front surface, a left surface, a right surface, and a rear surface, and a front panel 12 coupled to the open front surface of the cabinet 11 and having the entry hole 12*h* formed therein. A top surface and a bottom of the cabinet 11 are open, and a horizontal base 15 supporting the washing machine may be coupled to the bottom surface. In addition, the casing 10 may further include a top plate 13 covering the open top surface of the cabinet 11, and a control panel 14 disposed over the front panel 12.

A tub containing water may be disposed inside the casing 10. An entrance hole (or a tub entrance hole 31*h*) is formed on the front surface of the tub 31 to receive laundry. The cabinet 11 and the tub 31 may be connected by an annular gasket 60.

A door 20 for opening and closing the entry hole 12*h* may be rotatably coupled to the casing 10. The door 20 may be open approximately at a central portion thereof, and may include a door frame 21 rotatably coupled to the front panel 12 and a transparent window 22 installed at the open central portion of the door frame 21. The window 22 may be in a shape that becomes convex rearward in such a way that at least a portion of the window 22 is located in an area surrounded by an inner circumferential surface of the gasket 60.

The gasket 60 prevents leakage of water contained in the tub 31. The gasket 60 may extend from an annular front part to an annular rear part to thereby form an annular passage that connects the entry hole 12*h* and the tub entrance hole 31*h*. The front part of the gasket 60 may be fixed to the front panel 12 of the casing 10, and the rear part of the gasket 60 may be fixed to a circumference of the tub entrance hole 31*h* of the tub 31.

The gasket 60 may be formed of a flexible or elastic substance. The gasket 60 may be formed of natural rubber or synthetic resin. The gasket 60 may be formed of a substance such as Ethylene Propylene Diene Monomer (EPDM), Thermo Plastic Elastomer (TPE), or the like. Hereinafter, a portion defining the inside of the annular shape of the gasket 60 is referred to as an inner circumferential part (or an inner circumferential surface) of the gasket 60, and a portion opposite thereto is referred to as an outer circumferential part (or an outer circumferential surface) of the gasket 60.

A drum 32 receiving laundry may be rotatably provided in the tub 31. In order to allow water contained in the tub to flow into the drum 32, a plurality of through holes 32*h* may be formed in the drum 32.

The drum 32 is disposed in such a way that an entrance hole to receive laundry is disposed at a front surface of the drum 32, and the drum 32 is rotated about a rotation center line C that is approximately horizontal. In this case, "horizontal" does not refer to the mathematical definition thereof. That is, even in the case where the rotation center line C is inclined at a predetermined angle relative to a horizontal state, the axis is more like in the horizontal state than in a vertical state, and thus, it is considered that the rotation center line is substantially horizontal.

A plurality of lifter 34 may be provided on an inner surface of the drum 32. The plurality of liters 34 may be disposed at a predetermined angle relative to the center of the drum 32. When the drum 32 is rotated, laundry repeatedly goes through an operation of being lifted by the lifter 34 and falling.

A driving unit 38 for rotating the drum 32 may be further provided. A driving shaft 38*a* to be rotated by the driving unit 38 may penetrate the rear of the tub 31 to be coupled to the drum 32.

Preferably, the driving unit 38 includes a direct drive wash motor, and the wash motor may include a stator fixed to the rear of the tub 31, and a rotor rotating by a magnetic force acting in relation with the stator. The driving shaft 38*a* may rotate integrally with the rotor.

The tub 31 may be supported by a damper 16 installed at the base 15. Vibration of the tub 31 caused by rotation of the drum 32 is attenuated by the damper 16. In some embodiments, although not illustrated, a hanger (e.g., a spring) for hanging the tub 31 to the casing 10 may be further provided.

There may be provided at least one water supply horse (not shown) for guiding water introduced from an external water source such as a water tap or the like to the tub 31, and a water supply unit 33 for controlling the water supplied through the at least one water supply horse to flow to at least one water supply pipe 34*a*, 34*b*, or 34*c* which will be described later.

A dispenser 35 for supplying additives such as detergent for washing, fabric softener, and the like into the tub 31 or the drum 32 may be provided. The additives are contained in the dispenser 35 separately by types thereof. The dispenser 35 may include a detergent container (not shown) for containing detergent for washing, and a fabric softer container (not shown) for containing a fabric softener.

At least one water supply pipe 34*a*, 34*b*, or 34*c* for selectively guiding water supplied from the water supply unit 33 to each container of the dispenser 35 may be provided. The water supply unit 33 may include at least one water supply valve (not shown) for regulating each of the at least one water supply pipe 34*a*, 34*b*, or 34*c*.

The at least one water supply pipe 34*a*, 34*b*, or 34*c* may include a first water supply pipe 34*a* for supplying cold water supplied through a cold water supply horse to the detergent container, a second water supply pipe 34*b* for supplying water supplied through the cold water supply horse to the fabric softer container; and a third water supply pipe 34*c* for supplying hot water supplied through a hot water supply horse to the detergent container.

The gasket 60 may include a direct nozzle 42 for spraying water into the drum 32, and a direct water supply tube 39 for guiding water supplied from the water supply unit 33 to the direct nozzle 42. The direct nozzle 42 may be a whirl nozzle or a spray nozzle, but aspects of the present invention are not necessarily limited thereto. When viewed from the front, the direct nozzle 42 may be disposed vertically above the rotation center line C.

Water discharged from the dispenser 35 may be supplied to the tub 31 through a water supply bellows 37. A water supply hole (not shown) connected to the water supply bellows 37 may be formed on a side surface of the tub 31.

A drain hole for draining water may be formed in the tub 31, and a drain bellows 17 may be connected to the drain hole. A pump 901 for pumping water discharged from the tub 31 through the drain bellows 17 may be provided. A drain valve 96 for regulating the drain bellows 17 may be further provided.

The pump 901 may selectively perform a draining function of pumping water drained through the drain bellows 17 to a drain pipe 19, and a circulation function of pumping water to a circulation tube 18. Hereinafter, circulating water pumped by the pump 90 to be guided along the circulation tube 18 may be referred to as circulating water.

Referring to FIGS. 5 and 6, the pump 901 may include a pump housing 91, a first pump motor 92, a first impeller 915, a second pump motor 93, and a second impeller 917.

An inlet port 911, a circulation port 912, and a drain port 913 may be formed in the pump housing 91. A first chamber 914 for housing the first impeller 915, and a second chamber 916 for housing the second impeller 917 may be formed in the pump housing 91. The first impeller 915 is rotated by the first pump motor 92, and the second impeller 917 is rotated by the second pump motor 93.

The first chamber 914 and the circulation port 912 forms a volute-shaped flow path that is rolled in a direction of rotation of the first impeller 915, and the second chamber 916 and the drain port 913 forms a volute-shaped flow path that is rolled in a direction of rotation of the second impeller 917. Herein, a direction of rotation of each of the impellers 915 and 917 are preset to be controllable.

The inlet port 911 is connected to the drain bellows 17, and the first chamber 914 and the second chamber 916 communicate with the inlet port 911. Water discharged from the tub 31 through the drain bellows 17 is supplied to the first chamber 914 and the second chamber 916 through the inlet port 911.

The first chamber 914 communicates with the circulation port 912, and the second chamber 916 communicates with the drain port 913. Accordingly, if the first impeller 915 is rotated as the first pump motor 92 operates, water in the first chamber 914 is discharged through the circulation port 912. In addition, if the second pump motor 93 operates, the second impeller 917 is rotated and thereby water in the second camber 916 is discharged through the drain port 913. The circulation port 912 is connected to the circulation pipe 18, and the drain port 913 is connected to the drain pipe 19.

An amount of water to be discharged from (or discharge pressure) of the pump 901 is variable. To this end, the pump motors 92 and 93 are speed-variable motors of which speeds or rotation is controllable. Each of the pump motors 92 and 93 is preferably, but not limited to, a Brushless Direct current Motor (BLDC). A driver for controlling speeds of the pump motors 92 and 93 may be further provided, and the driver may be an inverter driver. The inverter driver inverts AC power into DC power, and inputs the DC power to the motors at a target frequency.

A controller (not shown) for controlling the pump motors 92 and 93 may be further provided. The controller may include a Proportional-Integral (PI) controller, a Proportional-Integral-Derivative (PID) controller), and the like. The controller may receive an output value (e.g., an output current) of a pump motor, and control an output value of the driver based on the received output value of the pump motor so that the number of times of rotation of the pump motor follows a preset target number of times of rotation.

The controller is capable of controlling not just speeds of rotation of the pump motors 92 and 93, but also directions of rotation thereof. In particular, a motor applied in a conventional pump is not capable of controlling a direction of rotation in a driving operation, and thus, it is difficult to control rotation of each impeller in a predetermined direction, as shown in FIGS. 6A and 6B, which causes a problem that the amount of water to be discharged from the outlet port 912 and 913 differs depending on directions of rotation of the impellers. On the contrary, the present invention prevents such a problem because a direction of rotation in a driving operation of the pump motors 92 and 93 is controllable, and an amount of water to be discharged through the outlet ports 912 and 913 may be maintained at a constant level.

Meanwhile, the controller is capable of controlling not just the pump motors 92 and 93, but also overall operations of the washing machine. It is understood that each component described in the following is controlled by the controller.

Figure 7:
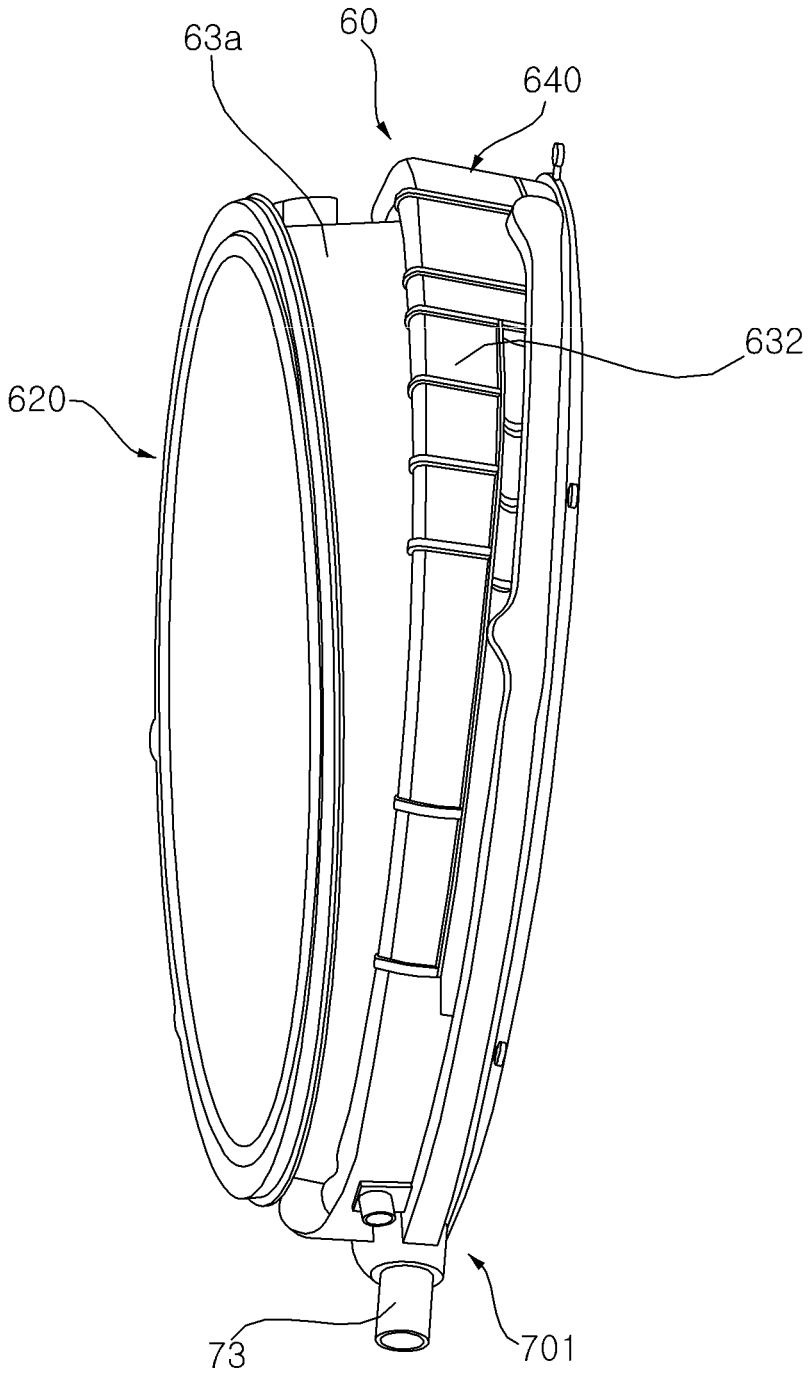
FIG. 7 is a perspective view illustrating the state in which the gasket shown in FIG. 3 and a distribution pipe are coupled.
Figure 8:
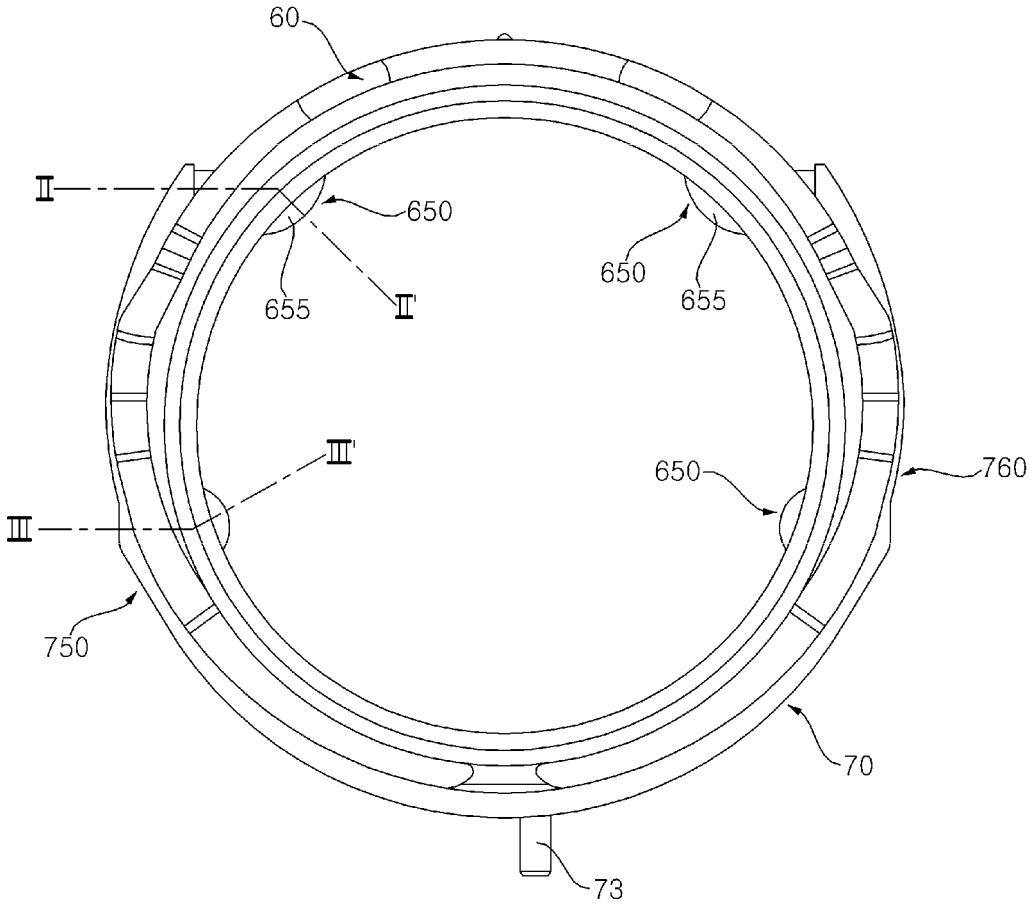
FIG. 8 is a front view of FIG. 7.
Figure 9:
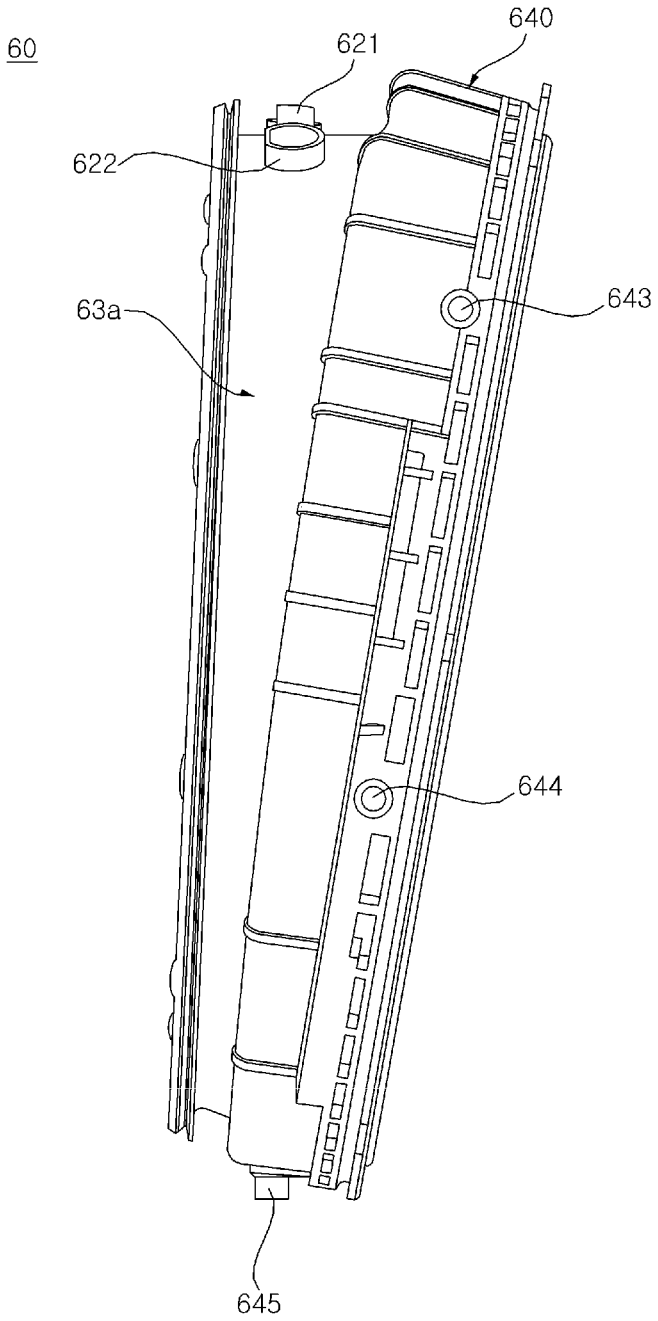
FIG. 9 is a sectional right side view of the gasket shown in FIG. 7.
Figure 11:
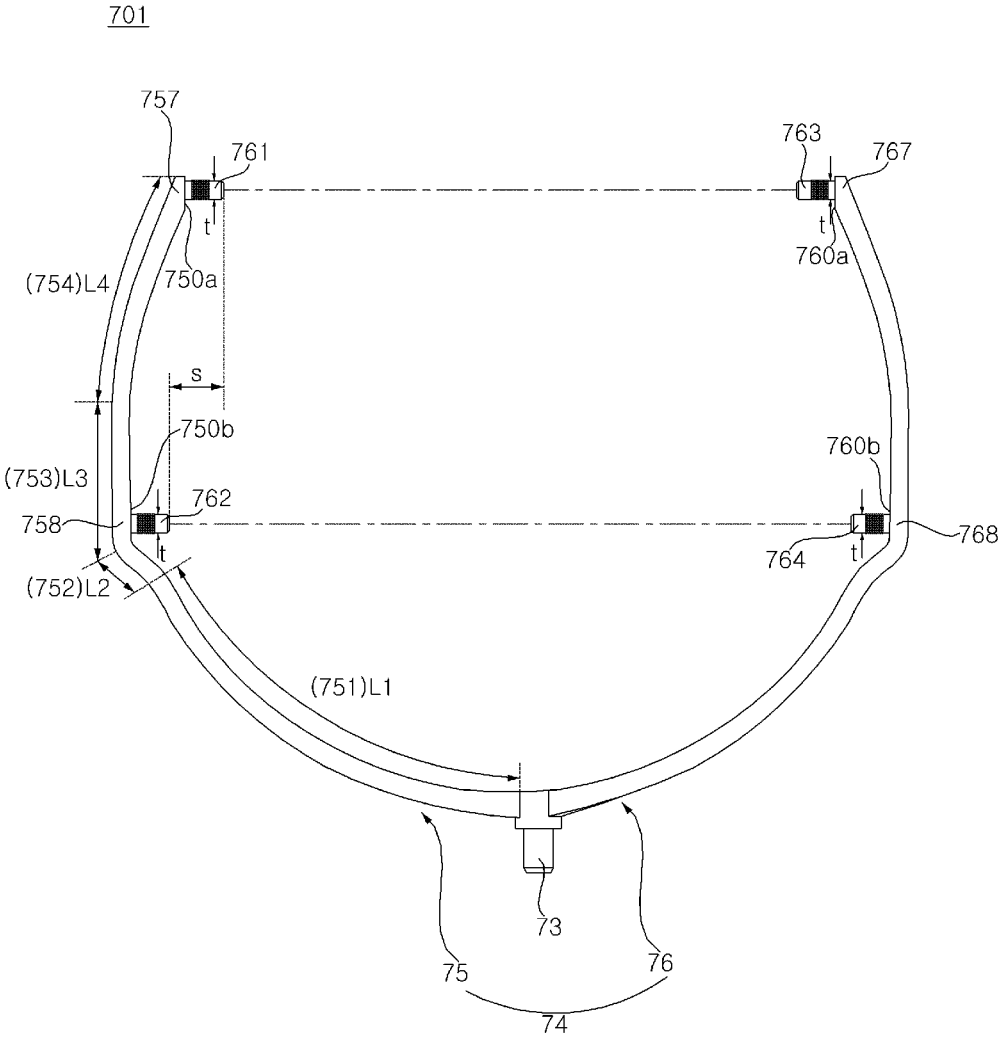
FIG. 11 is a front view of the distribution pipe shown in FIG. 7.
Figure 12:
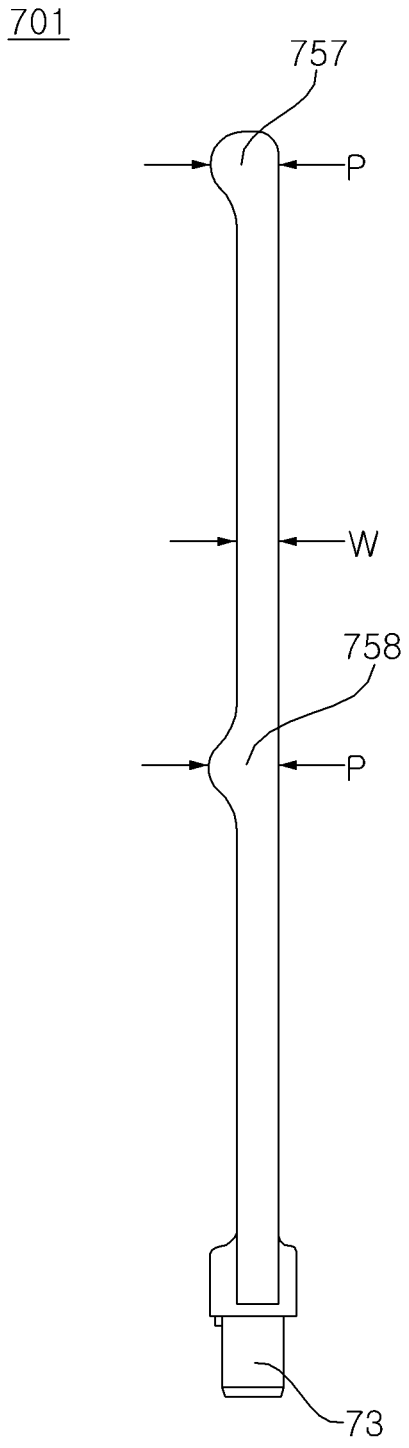
FIG. 12 is a sectional right side view of FIG. 11.
Figure 13:
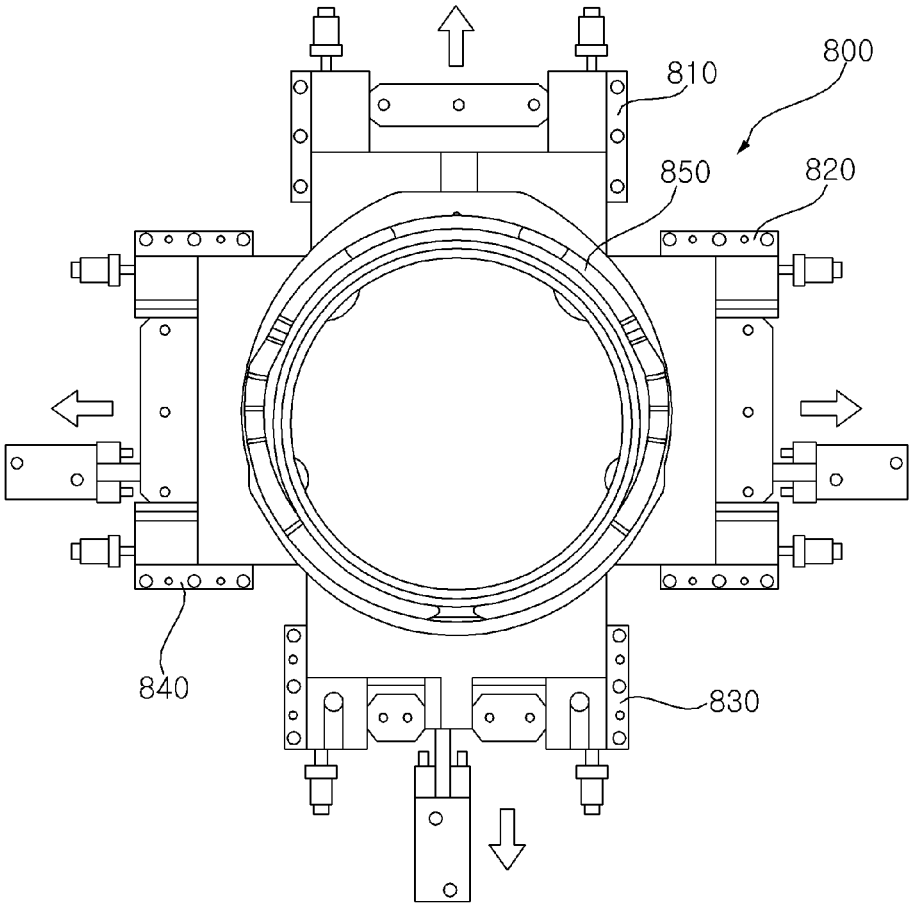
FIG. 13 is a plan view of an injection mold for manufacturing a gasket according to an embodiment of the present invention.
Figure 14:
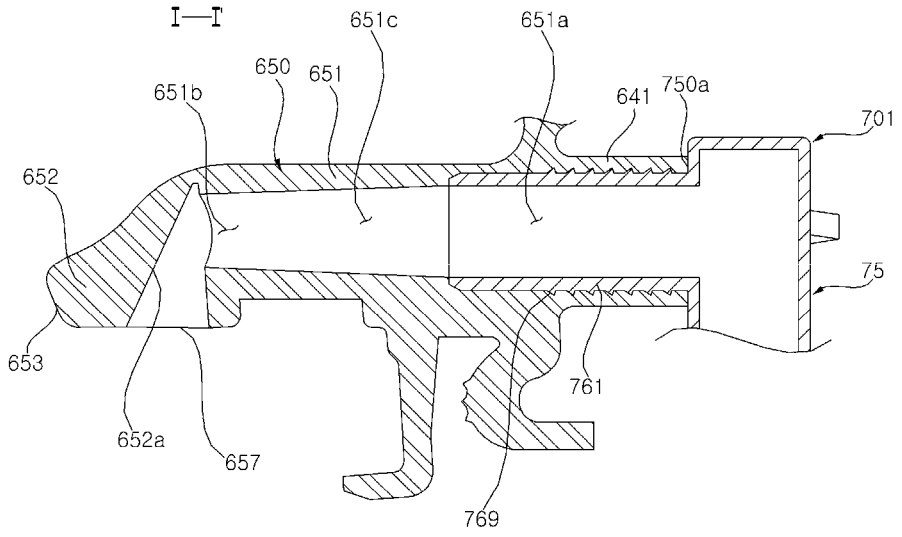
FIG. 14 is a cross-sectional view illustrating a structure in which the distribution pipe shown in FIG. 7 and a nozzle are coupled.
Figure 15:
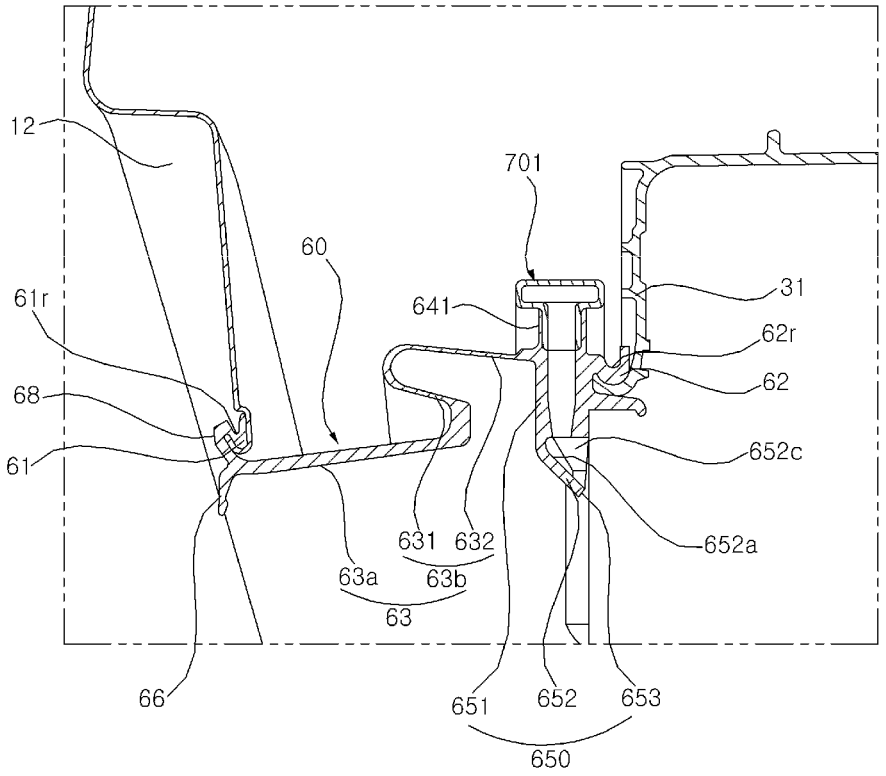
FIG. 15 is a cross-sectional view taken along line II-II' in FIG. 8.
Figure 16:
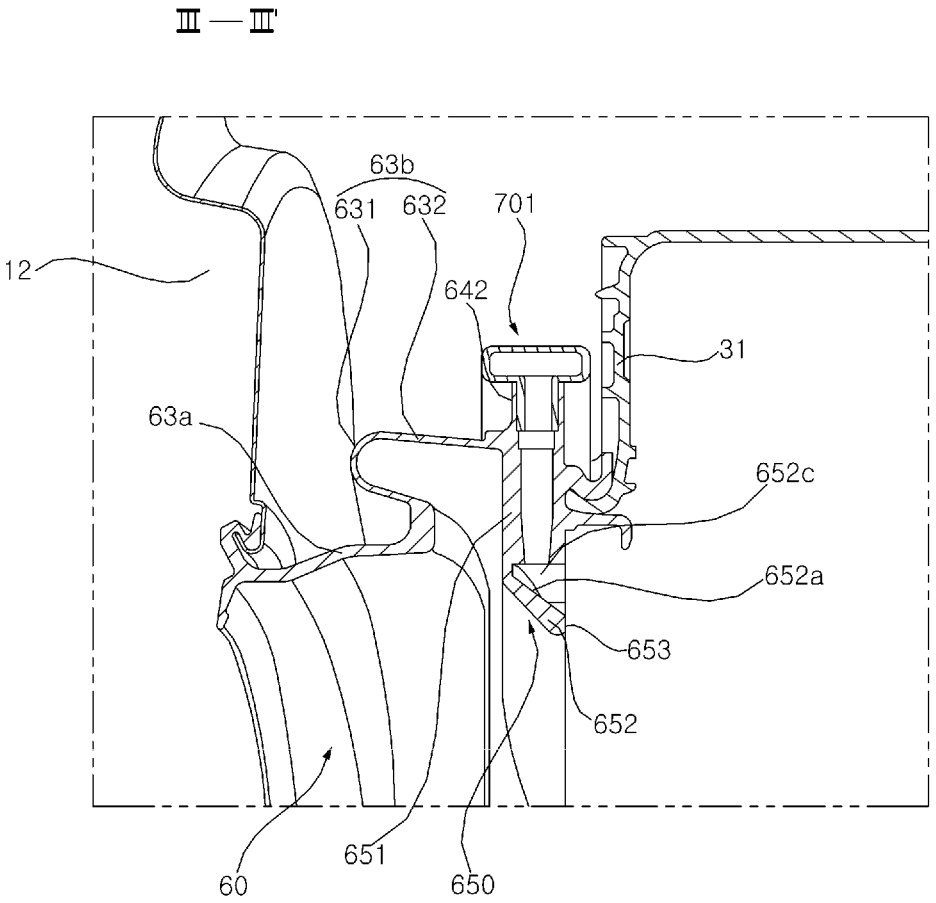
FIG. 16 is a cross-sectional view taken along line III-III' in FIG. 8.

FIG. 7 is a perspective view illustrating the state in which the gasket shown in FIG. 3 and a distribution pipe are coupled. FIG. 8 is a front view of FIG. 7. FIG. 9 is a sectional right side view of the gasket shown in FIG. 7. FIG. is a rear view of the gasket shown in FIG. 7. FIG. 11 is a front view of the distribution pipe shown in FIG. 7. FIG. 12 is a sectional right side view of FIG. 11. FIG. 13 is a plan view of a injection mold for manufacturing a gasket according to an embodiment of the present invention. FIG. 14 is a cross-sectional view illustrating a structure in which the distribution pipe shown in FIG. 7 and a nozzle are coupled. FIG. 15 is a cross-sectional view taken along line II-II' in FIG. 8. FIG. 16 is a cross-sectional view taken along line III-III' in FIG. 8.

Referring to FIGS. 7 to 16, the gasket 60 may include a casing coupling part 61 coupled to a circumference of the entry hole 12*h* of the front panel 12, a tub coupling part 62 coupled to a circumference of the tub entrance hole 31*h*, and a gasket body 63 extending between the casing coupling part 61 and the tub coupling part 62.

The circumference of the entry hole 12*h* in the front panel 12 may be rolled outward, and the casing coupling part 61 may be fitted in a concave area formed by the outward rolled portion. An annular groove 61*r* to be wound by a wire may be formed in the casing coupling part 61. After the wire winds around the groove 61*r*, both ends of the wire are bound, and therefore, the casing coupling part 61 is tightly fixed to the circumference of the entry hole 12*h*.

The circumference of the entrance hole of the tub 31 is rolled outward, and the tub coupling part 62 is fitted in a concave area formed by the outward rolled portion. An annular groove 62*r* to be wound by a wire may be formed in the tub coupling part 62. After the wire winds around the groove 62*r*, both ends of the wire are bound, and therefore, the tub coupling part 62 is tightly coupled to the entrance hole of the tub 31.

While the casing coupling part 61 is fixed to the front panel 12, the tub coupling part 62 is displaceable in accordance with movement of the tub 31. Accordingly, the gasket body 63 needs to be able to transform in accordance with the displacement of the tub coupling part 62. In order to allow the gasket body 63 to transform easily, the gasket 60 may include a folding part 63*b* between the casing coupling part 61 and the tub coupling part 62 (or the gasket body 63), and the folding part 63*b* is folded as the tub 31 moves in a direction of eccentricity (or a radial direction).

More particularly, referring to FIGS. 14 to 16, an annular rim part 63*a* extending from the casing coupling part 61 toward the tub coupling part 62 (or toward the rear) is formed in the gasket body 63, and the folding part 63*b* may be formed between the rim part 63*a* and the tub coupling part 62.

The gasket 60 may include an outer door contact part 68 that bends outwardly from the front end of the rim part 63*a* to be brought into contact with a rear surface 20 of the door 20 in the outside of the entry hole 12*h* in a state in which the door 20 is closed. In the casing coupling part 61, the above-described groove 61*r* may be formed at a portion extending from the outer end of the outer door contact part 68.

The gasket 60 may further include an inner door contact part 66 that bends inwardly from the front end of the rim part 63*a* to be brought into contact with the rear surface (preferably the window 22) of the door 20 in the inside of the entry hole 12*h* in a state in which the door 20 is closed.

Meanwhile, during rotation, the drum 32 vibrates (which means that the rotation center line C of the drum 32 moves) and, in turn, the center line of the tub 31 (which is approximately identical to the rotation center line C of the drum 32) moves as well. In this case, a moving direction (hereinafter, referred to as an eccentric direction") has a radial direction component.

The folding part 63*b* is folded or unfolded when the tub 31 moves in the eccentric direction. The folding part 63*b* may include an inner circumferential portion 631 bent from the rim part 63*a* toward the casing coupling part 61, and an outer circumferential portion 632 bent from the inner circumferential portion 631 toward the tub coupling part 32 to be thereby connected to the tub coupling part 62. When viewed from the front, the inner circumferential portion 631 is disposed in the inside surrounded by the outer circumferential portion 632. As shown in FIG. 16, the rim part 63*a* and the folding part 63*b* may form a sectional surface having an approximate "S" shape.

If a portion of the folding part 63*b* is folded when the center of the tub 31 moves in the eccentric direction, a distance between the inner circumferential portion 631 and the outer circumferential portion 632 at the portion is reduced, whereas the folding part 62 is unfolded at a portion opposite to the folded portion and thereby a distance between the inner circumferential portion 631 and the outer circumferential portion 632 at the opposite portion is increased.

A direct nozzle 42 and a steam spray nozzle 47 may be installed at the rim part 63*a*. Referring to FIG. 2, a rim part 620 may include a direct nozzle port 621 where the direct nozzle 42 is installed, and a steam spray nozzle port 622 where the steam spray nozzle 47 is installed. The direct nozzle port 621 and the steam spray nozzle port 820 may be formed integrally with the gasket 60.

When viewed from the front, a plurality of port receiving pipes 641, 642, 643, and 644 may be disposed on the on the left side and/or the right side of the outer circumferential portion 632. Specifically, when viewed from the front, the gasket body 63 is divided into a first area and a second area, which respectively correspond to the left and right sides of the gasket body 63. First and second port receiving pipes 641 and 642 are disposed in the first area (e.g., the left area of a reference line L) in a top-to-bottom direction and parallel to each other. Third and fourth port receiving pipes 643 and 644 are disposed in the second area (e.g., the right area of the reference line L) in the top-to-bottom direction and parallel to each other.

The port receiving pipes 641, 642, 643, and 644 may protrude outwardly from the outer circumferential portion 632. In the present embodiment, two of the port receiving pipes 641, 642, 643, and 644 are disposed on the left side of the outer circumferential portion 632, and the other two are disposed on the right side of the outer circumferential portion 632. For distinction, such pipes are respectively referred to as a first port receiving pipe 641, a second port receiving pipe 642, a third port receiving pipe 643, and a fourth port receiving pipe 644.

Referring to FIG. 8, a plurality of nozzles 650 may be disposed on an inner circumferential surface of the gasket 60. Preferably, the plurality of nozzles 650 may be disposed on an inner circumferential surface of the outer circumferential part 632. In order to correspond to the four port receiving pipes 641, 642, 643, and 644, there may be provided four nozzles 650*a*, 650*b*, 650*c*, and 650*d* (see FIG. 17). Each of the port receiving pipes 641, 642, 643, and 644 communicates with a corresponding nozzle in the nozzles 650*a*, 650*b*, 650*c*, and 650*d*. That is, a through-hole formed in each of the port receiving pipes 641, 642, 643, and 644 communicates with an entrance hole of a corresponding nozzle in the nozzles 650*a*, 650*b*, 650*c*, and 650*d*.

The second port receiving pipe 642 is disposed below the first port receiving pipe 641. The first port receiving pipe 641 and the second port receiving pipe 642 may be disposed in parallel with each other. The first port receiving pipe 641 and the second port receiving pipe 642 may extend in a horizontal direction (or a left-and-right direction. Through holes respectively formed in the first port receiving pipe 641 and the second port receiving pipe 642 may extend horizontally and be parallel to each other.

Figure 10:
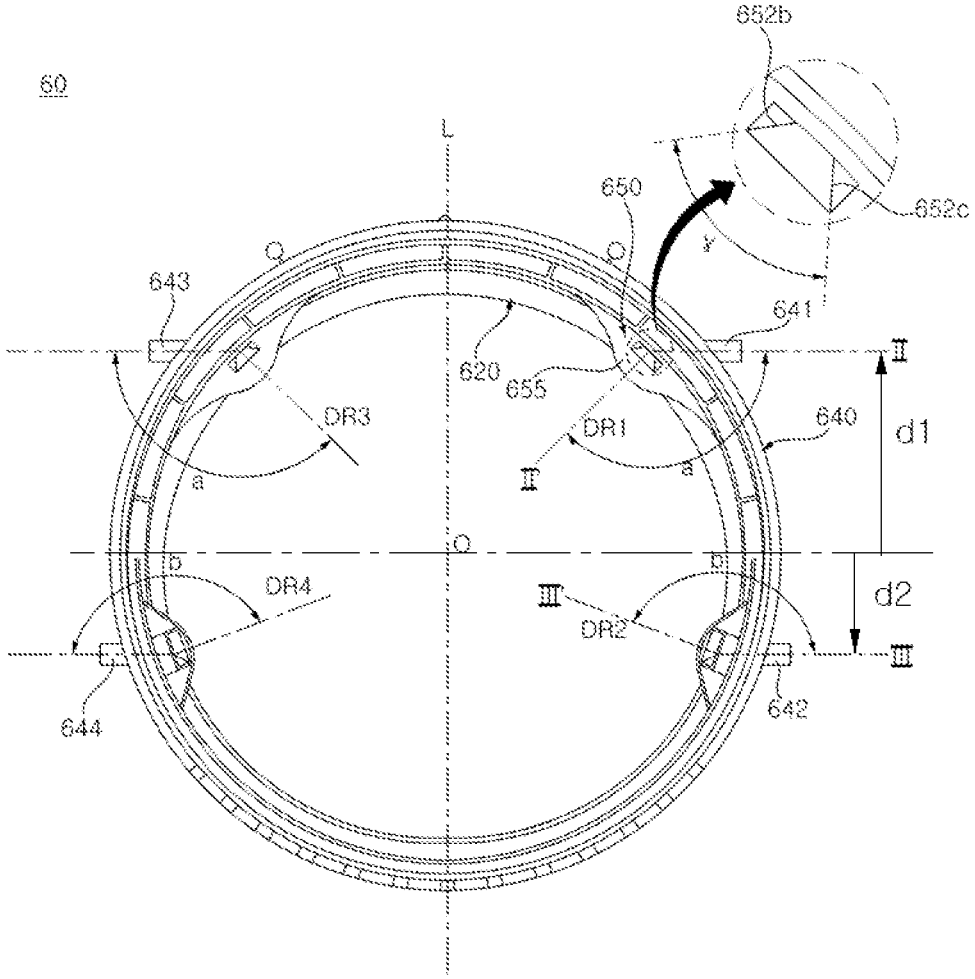
FIG. 10 is a rear view of the gasket shown in FIG. 7.

Referring to FIG. 10, the second port receiving pipe 642 may be shorter than the first port receiving pipe 641. The first port receiving pipe 641 may be disposed higher at a first distance d1 than a middle height point of the gasket 63 (preferably, a height point where the center O is located).

The second port receiving pipe 642 is disposed lower at a second distance d2 than the middle height point O of the gasket body 63. Here, the second distance d2 is smaller than the first distance d1 (d2<d1).

The exterior appearance of the gasket body 63 is approximate a round shape, and thus, if a random point on the outer circumferential portion 632 is closer to the middle height point O in an upward or downward direction, the random point may be relatively distal from a symmetry reference line L. Thus, in the present embodiment, a connection point between the second port receiving pipe 642 and the outer circumferential portion 632 is distal from the symmetry reference line L than a connection point between the first port receiving pipe 641 and the outer circumferential portion 632, and it appears that the second port receiving pipe 642 protrudes rightward further from the symmetric reference line L. Accordingly, it is preferable that a length of the second port receiving pipe 642 is set relatively short so as to secure a space to install a distribution pipe 70 between the gasket body 63 and the cabinet 11. Likewise, a length of the fourth port receiving pipe 644 may be shorter than a length of the third port receiving pipe 643.

The fourth port receiving pipe 644 is disposed below the third port receiving pipe 643. The third port receiving pipe 643 and the fourth port receiving pipe 644 may be disposed in parallel with each other. The third port receiving pipe 643 and the fourth port receiving pipe 644 may extend in a horizontal direction (or a left-and-right direction. Through holes respectively formed in the third port receiving pipe 643 and the fourth port receiving pipe 644 may extend horizontally and be parallel to each other.

Referring to FIG. 9, a residual water port 645 for draining wash water stagnating in the gasket 60 may be provided at the bottom of the outer circumferential portion 632. The residual water port 645 may protrude downward from the outer circumferential surface of the outer circumferential portion 632. Through the residual water port 645, wash water stagnating in the folding part 63*b* may be drained.

Meanwhile, the gasket 60 may be fabricated using an injection molding machine 800. Specifically, referring to FIG. 13, the injection molding machine 800 includes a fixed mold 850, and movable molds 810, 820, 830, and 840 capable of moving relative to the fixed mold 850. The movable molds 810, 820, 830, and 840 may include a first movable mold 810, a second movable mold 820, a third movable mold 830, and a fourth movable mold 840.

Molten synthetic resin discharged from an injection machine (not shown) is injected into a cavity that is formed by the fixed mold 850, the first movable mold 810, the second movable mold 820, the third movable mold 830, and the fourth movable mold 840.

The fixed mold 850 may be disposed at the center, and the first movable mold 810, the second movable mold 820, the third movable mold 830, and the fourth movable mold 840 may be disposed on a circumference of the fixed mold 850. When the molds are opened up, the first movable mold 810 moves in a forward direction (the upward direction in FIG. 13) from the fixed mold 850, the second movable mold 820 moves in a rightward direction from the fixed mold 850, the third movable mold 830 moves in a rearward direction (the downward direction in FIG. 13) from the fixed mold 850, and the fourth movable mold 840 moves in a leftward direction from the fixed mold 850.

The direct nozzle port 621 and the steam spray nozzle port 622 disposed in an upper side of the gasket 60 may be molded by the first movable mold 810. Since the direct nozzle port 621 and the steam spray nozzle port 622 extend in the moving direction of the first movable mold 810, mold stripping may be performed smoothly.

The residual water port 645 disposed in a lower side of the gasket 60 may be molded by the third movable mold 830. Since the residual water port 645 extends in the moving direction of the third movable mold 830, mold stripping may be performed smoothly.

The first port receiving pipe 641 and the second port receiving pipe 642 disposed on the left side of the gasket 60 may be molded by the fourth movable mold 840. The fourth movable mold 840 may move in the left direction, and the first port receiving pipe 641 and the second port receiving pipe 642 may protrude in a direction identical to the moving direction (that is, the left direction) of the fourth movable mold 840.

The first port receiving pipe 641 and the second port receiving pipe 642 may be disposed in parallel with each other. In other words, a direction in which the first port receiving pipe 641 protrudes from the outer circumferential surface of the outer circumferential portion 632 may be identical to a direction in which the second port receiving pipe 642 protrudes from the outer circumferential surface of the outer circumferential portion 632.

The third port receiving pipe 643 and the fourth port receiving pipe 644 disposed on the right side of the gasket 60 may be molded by the second movable mold 820. The second movable mold 820 may move in the right direction, and the third port receiving pipe 643 and the fourth port receiving pipe 644 may protrude in a direction identical to the moving direction (that is, the right direction) of the second movable mold 820.

The third port receiving pipe 643 and the fourth port receiving pipe 644 may be disposed in parallel with each other. In other words, a direction in which the third port receiving pipe 643 protrudes from the outer circumferential surface of the outer circumferential portion 632 may be identical to a direction in which the fourth port receiving pipe 644 protrudes from the outer circumferential surface of the outer circumferential portion 632.

Since the first movable mold 810, the second movable mold 820, the third movable mold 830, and the fourth movable mold 840 move in different directions (or the first movable mold 810 and the third movable mold 830 moves in different directions and the second movable mold 820 and the fourth movable mold 840 move in different directions), receiving pipes or ports may be formed on the upper side, the left side, the right side, and the lower side of the gasket 60, respectively.

The gasket body 63 may be symmetrical about the symmetry reference line L. The first port receiving pipe 641 and the third port receiving pipe 643 may be disposed at the same height. The second port receiving pipe 642 and the fourth port receiving pipe 644 may be disposed at the same height. The first port receiving pipe 641 and the third port receiving pipe 643 may be in a vertically symmetrical structure which is a structure symmetrical about the symmetry reference line L. Likewise, the second port receiving pipe 642 and the fourth port receiving pipe 644 may be in a vertically symmetrical structure.

Meanwhile, referring to FIG. 7, a width of the rim part 63*a* may gradually increase in the upward direction (or a front-and-back direction). In this case, in response to the increasing width of the inner circumferential portion 631, the outer circumferential portion 632 is positioned further rearward in the upward direction. Accordingly, the third port receiving pipe 643 is closer to the tub 31 than the fourth port receiving pipe 644, and the first port receiving pipe 641 is closer to the tub 31 than the second port receiving pipe 642.

[Nozzle]

There may be provided a plurality of nozzles 650*a*, 650*b*, 650*c*, and 650*d* that discharges circulating water into the drum 32. The plurality of nozzles 650*a*, 650*b*, 650*c*, and 650*d* are respectively connected to the first port receiving pipe 641, the second port receiving pipe 642, the third port receiving pipe 643, and the fourth port receiving pipe 644. Hereinafter, a nozzle communicating with the first port receiving pipe 641 to receive circulating water is referred to as a first nozzle 650*a*, a nozzle communicating with the second port receiving pipe 642 to receive circulating water is referred to as a second nozzle 650*b*, a nozzle communicating with the third port receiving pipe 643 to receive circulating water is referred to as a third nozzle 650*c*, and a nozzle communicating with the fourth port receiving pipe 644 to receive circulating water is referred to as a fourth nozzle 650*d* (see FIG. 17).

As described above, the plurality of port receiving pipes 641, 642, 643, and 644 extends horizontally, and a plurality of outlet ports 761, 762, 763, and 764 described in the following extends horizontally as well to correspond to the plurality of port receiving pipes 641, 642, 643, and 644. Accordingly, circulating water is supplied or guided by each of the outlet ports 761, 762, 763, and 764 in a horizontal direction.

The nozzles 650*a*, 650*b*, 650*c*, and 650*d* may be configured to discharge circulating water, supplied in the horizontal direction as described above, in a direction that forms a predetermined angle relative to the horizontal direction. That is, although circulating water is supplied in the horizontal direction through each of the outlet ports 761, 762, 763, and 764 or the port receiving pipes 641, 642, 643, and 644, a direction in which each of the nozzles 650*a*, 650*b*, 650*c*, and 650*d* discharges the circulating water may be upward or downward at a predetermined angle relative to the horizontal direction.

Figure 17:
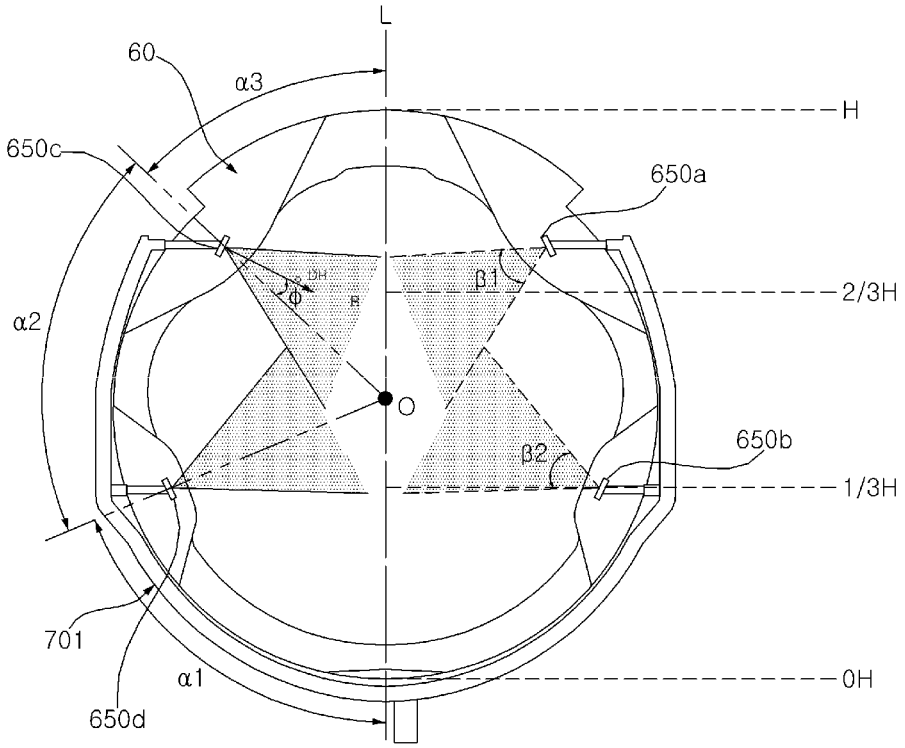
FIG. 17 illustrates an assembly of a gasket and a distribution pipe and particularly positions of nozzles and a spray width of each nozzle.

FIG. 17 illustrates an assembly of a gasket and a distribution pipe and particularly positions of nozzles and a spray width of each nozzle. Referring to FIG. 17, as described above, four nozzles 650 may be provided in the gasket 60. Hereinafter, two nozzles 650*a* and 650*c* at upper positions in the four nozzles 650 are referred to as upper nozzles 650*a* and 650*c*. When viewed from the front, the left nozzle in the upper nozzles 650*a* and 650*c* is referred to as a first upper nozzle and the right nozzle in the upper nozzles 650*a* and 650*c* is referred to as a second upper nozzle 650*c*.

The upper nozzles 650*a* and 650*c* are located higher than the center O of the gasket 60 to thereby spray circulating water downward. Here, the center O is a predetermined point located on the symmetry reference line L of the gasket 60. The center O is preferably located at a half the height H of the gasket body 63, but aspects of the present invention are not limited thereto.

When viewed from the front, the first upper nozzle 650*a* is disposed in the left area of the reference line L to thereby spray circulating water downward toward the right area of the reference line. When viewed from the front, the second upper nozzle 650*c* is disposed in the right area of the reference line L to thereby spray circulating water downward toward the left area of the reference line L.

The first upper nozzle 650*a* and the second upper nozzle 650*c* may be vertically symmetrical about the reference line L. Accordingly, the form of water streams sprayed through the first upper nozzle 650*a* and the second upper nozzle 650*c* are symmetrical about the reference line L.

In addition, two nozzles positioned below the upper nozzles 650*a* and 650*c* are referred to as lower nozzles 650*b* and 650*d*. When viewed from the front, the left one in the lower nozzles 650*b* and 650*d* is referred to as a first lower nozzle 650*b* and the right one in the lower nozzles 650*b* and 650*d* is referred to as a second lower nozzle 650*d*.

When viewed from the front, the first lower nozzle 650*b* is disposed in the left area of the reference line L to thereby spray circulating water upward toward the right area of the reference line L.

When viewed from the front, the second lower nozzle 650*d* is disposed in the right area of the reference line L to thereby spray circulating water upward toward the left area of the reference line L.

The first lower nozzle 650*b* and the second lower nozzle 650*d* may be vertically symmetrical about the reference line L. Accordingly, the form of water streams sprayed through the first lower nozzle 650*b* and the second lower nozzle 650*d* are symmetrical about the reference line L.

Referring to FIGS. 10, 11, and 14, the nozzle 650*a* may be formed in the gasket body 63 of the gasket 60 and preferably protrude from the inner circumferential surface of the outer circumferential portion 632. The nozzle 650*a* may include a nozzle conduit 651 and a nozzle head 652. Specifically, the nozzle conduit 651 is in an annular shape and connected to the nozzle head 652 protruding from the inner circumferential surface of the outer circumferential portion 632.

Referring to FIGS. 10 and 15 to 17, the nozzle head 652 may include a collision surface 652*a* with which water discharged from the outlet port 641 collides, and a first side surface 652*b* and a second side surface 652*c*, which are disposed on both sides of the collision surface 652*a*. A cone-shaped space is formed by the collision surface 652*a*, the first side surface 652*b*, and the second side surface 652*c*, and water discharged from the nozzle conduit 651 collides with the collision surface 652*a* in the space and is then discharged through a spray hole 657.

The first side surface 652*b* and the second side surface 652*c* extend from the left edge and the right edge of the collision surface 652, respectively, and define the left and right boundaries of a water stream flowing along the collision surface 652*a*.

An angle γ formed by the first side surface 652*b* and the second side surface 652*c* is approximately between 45° and 55° and preferably 50°, but aspects of the present invention are not limited thereto.

If a spray width of each water stream sprayed through the nozzles 650 is defined by a spray width angle, the spray width angle may be defined by the first side surface 652*b* and the second side surface 652*c*. Specifically, the spray width angle may be defined as an angle formed by a first boundary, where the collision surface 652*a* and the first side surface 652*b* meet, and a second boundary, where the collision surface 652*a* and the second side surface 652*c* meet.

Referring to FIG. 17, a spray width angle β1 for the upper nozzles 650*a* and 650*c* may be smaller than a spray width angle β2 for the lower nozzles 650*b* and 650*d*. While water supplied through an inlet port 73 rises along a distribution pipe 701, some of the circulating water is sprayed through the lower nozzles 650*b* and 650*d* and the rest of the circulating water is sprayed through the upper nozzles 650*a* and 650*c*. Thus, an amount of water discharged through the upper nozzles 650*a* and 650*c* is less than an amount of water discharged through the lower nozzles 650*b* and 650*d*. Accordingly, if the spray width of the upper nozzles 650*a* and 650*c* is set to be smaller than the spray width of lower nozzles 650*b* and 650*d* ($\beta1<\beta2$) to thereby relatively compensate for discharge pressure of the upper nozzles 650*a* and 650*c*, water may be discharged from all of the nozzles 650*a*, 650*b*, 650*c*, and 650*d* with substantially uniform discharge pressure.

A difference $\beta2-\beta1$ between the spray width angle $\beta2$ for the lower nozzles 650*b* and 650*d* and the spray width angle $\beta1$ for the upper nozzles 650*a* and 650*c* may be approximately between 4° and 6° and preferably 5°. In this case, $\beta1$ is approximately between 38° and 42° and preferably 40°, and $\beta2$ is approximately between 43° and 47° and preferably 45°.

Meanwhile, a spray direction for each upper nozzle 650*a* or 650*c* may form an upward deviation angle $\Phi$ relative to a line R that connects each upper nozzle 650*a* or 650*c* and the center O of the gasket 60 (which is referred to as a "nozzle alignment line"). Here, a spray direction DR of each upper nozzle 650*a* or 650*c* is defined along a straight line equally dividing the angle formed by the first side surface 652*b* and the second side surface 652*c*, and the spray direction DR is higher than the nozzle alignment line R. The upward deviation angle $\Phi$ may be between 5° and 9° and preferably 7°.

Due to various conditions such as a height, a position, and the spray width angle $\beta1$ of each upper nozzle 650*a* or 650*c*, water may not be sprayed with sufficient pressure through each upper nozzle 650*a* or 650*c* and thus a sprayed water stream cannot travel a long distance in a straight line. For this reason, the spray direction of each upper nozzle 650*a* and 650 is set to be higher by the upward deviation angle $\Phi$ than the nozzle alignment line R, so that a water stream is able to reach an area which the nozzle alignment line R passes through even when discharge pressure for each upper nozzle 650*a* or 650*c* is not sufficient. Preferably, as shown in FIG. 17, the form of a water stream sprayed through each upper nozzle 650*a* and 650*c* may be substantially horizontally symmetrical to the form of a water stream sprayed through each lower nozzles 650*b* or 650*d*.

Meanwhile, in the case where an angle from the lowest point in the gasket body 63 to each lower nozzle 650*b* or 650*d* is $\alpha1$, each upper nozzle 650*a* or 650*c* is disposed between a position corresponding to the angle $\alpha1$ and the highest point H in the gasket 60, and each upper nozzle 650*a* or 650*c* may be disposed higher than a point corresponding to an angle calculated by equally dividing $180-\alpha1$. That is, in FIG. 17, $\alpha2$ has a value greater than $\alpha3$. A value of $\alpha2-\alpha3$ may be between 18° and 22° and preferably 20°. In this case, $\alpha2$ may be between 63° and 67° and preferably 65°.

Meanwhile, each lower nozzle 650*b* or 650*d* may be located about at a one-third (⅓H) point of the height H of the gasket body 63. In this case, it is preferable that $\alpha2$ is set within a range where each upper nozzles 650*a* or 650*c* is located higher than a two-third (⅔H) point of the height of the gasket body 63, and, at this point, $\alpha2$ may be 65°.

In order to spray circulating water evenly upward and downward in the drum, it is preferable that the upper nozzles 650*a* and 650*c* and the lower nozzles 650*b* and 650*d* are disposed at an equal interval in a height direction. In this case, however, water streams sprayed from the upper nozzles 650*a* and 650*c* are sprayed downward due to the gravity, and there is a problem that the water stream actually reaches an area further downward than geometrically predicted. Therefore, considering that the water streams moving further downward due to gravity, the upper nozzles 650*a* and 650*c* need to be disposed at a point higher than the ⅔H point.

Meanwhile, when circulating is sprayed through the lower nozzles 650*b* and 650*d* upon operation of the pump 901, it is preferable that a water level of the tub 31 does not exceed the ⅓H point.

Meanwhile, referring to FIG. 10, when viewed from the front, a spray direction DR1 of the first nozzle 650*a* may form an angle a relative to a length direction of the first port receiving pipe 641 (or a direction in which water is introduced into the first nozzle 650*a*, that is, a water-introducing direction). Here, the angle a may be between 133° and 138°.

Since the first nozzle 650*a* and the third nozzle 650*c* are arranged symmetrically, an angle formed by a spray direction DR3 of the third nozzle 650*c* relative to the third port receiving pipe 643 is also the angle $\alpha$.

In addition, when viewed from the front, a spray direction DR2 of the second nozzle 650*b* may form an angle b a relative to a length direction of the second port receiving pipe 642 (or a direction in which water is introduced into the second nozzle 650*b*, that is, a water-introducing direction). Here, the angle b may be between 109° and 111°.

Since the second nozzle 650*b* and the fourth nozzle 650*d* are arranged symmetrically, an angle formed by a spray direction DR4 of the fourth nozzle 650*d* relative to the fourth port receiving pipe 644 is also the angle b.

Hereinafter, referring to FIGS. 14 to 16, the structure of the nozzles 650 will be described in more detail. The first nozzle 650*a* is illustrated as a representative example in FIGS. 14 to 16, but, since the second nozzle 650*b*, the third nozzle 650*c*, and the fourth nozzle 650*d* have substantially the same structure of the first nozzle 650*a*, the following description about the first nozzle 650*a* may apply even to the second nozzle 650*b*, the third nozzle 650*c*, and the fourth nozzle 650*d*.

The collision surface 652*a*, the first side surface 652*b*, and the second side surface 652*c* extend to an exit hole 657 (that is, a spray hole) of the nozzle head 652. The collision surface 652*a* of the nozzle head 652 may be formed to oppose an exit hole 651*b* of the nozzle conduit 651 and to be inclined in a depth direction of the drum 32.

Since the nozzle conduit 651 extends horizontally to thereby guide water in a horizontal direction, a water stream travels in a constant direction without influence of the gravity before reaching the nozzle head 652 and is then dispersed by the collision surface 652*a*. Accordingly, water may be sprayed in a uniform form from each of the nozzles 650*a*, 650*b*, 650*c*, and 650*d*.

If the length direction of the nozzle conduit 651 is not arranged approximately horizontally but arranged toward the center O of the gasket 60, the weight of gravity acts on downward movement of water flowing in the nozzle conduit 651 of each upper nozzle 650*a* or 650*cd*, and thus, this water may be sprayed faster than water sprayed from each lower nozzle 650*b* or 650*d*. Also, the weight of gravity acts on upward movement of water flowing in the nozzle conduit 651 of each lower nozzle 650*b* or 650*d*, and thus, this water may be sprayed slower than the water sprayed from each upper nozzle 650*a* or 650*c*. For this reason, it is difficult that water sprayed from the plurality of nozzles 650*a*, 650*b*, 650*c*, and 650*d* into the drum 32 have a uniform form. On the contrary, in the present embodiment, the length direction of the nozzle conduit 651 is arranged approximately horizontally, and thus, water sprayed from the plurality of nozzles 650*a*, 650*b*, 650*c*, and 650*d* into the drum 32 may have a uniform form.

Referring to FIG. 14, an entrance hole 651*a* of the nozzle conduit 651 may be larger in size than the exit hole 651*b*. Circulating water discharged from the exit hole 651*b* hits the collision surface 652*a* of the nozzle head 652 and is then sprayed into the drum 32 through the spray hole 657. A direction in which the spray hole faces and the length direction of the nozzle conduit 651 may intersect each other.

The gasket 60 may include a protruding part 655 protruding from the inner circumferential surface of the gasket body 63. To correspond to the plurality of nozzles 650*a*, 650*b*, 650*c*, and 650*d*, a plurality of protruding parts 655 may be formed along a circumferential direction. A spray hole 657 of each of the nozzles 650*a*, 650*b*, 650*c*, and 650*d* may be formed in a corresponding protruding part 655 (see FIG. 10).

The nozzle conduit 651 may include a flow path reducing portion 651*c* in which an inner dimeter is gradually reduced in a direction of travel of water. The inner diameter of the flow path reducing portion 651*c* may be gradually reduced until the nozzle head 652.

Meanwhile, at least a portion of the distribution pipe 701 may be disposed between the outer circumferential surface of the gasket 60 and a balancer 81 and 82. The distribution 701 may be installed in an existing space (that is, a space between the outer circumferential surface of the gasket 60 and the balancer 81 and 82), without need for an additional space for the installation.

The pair of the upper nozzles 650*a* and 650*c* may be formed higher than the inlet port 73, and arranged on the left and right sides of the inlet port 73, respectively. The pair of the upper nozzles 650*a* and 650*c* are disposed symmetrically about the reference line L passing through the center O (see FIG. 10), and thus, spray directions of the respective upper nozzles 650*a* and 650*c* are also symmetrical about the reference line L.

The pair of the upper nozzles 650*a* and 650*c* may be disposed higher than the center O or the center C of the drum 32. The respective upper nozzles 650*a* and 650*c* spray circulating water downward, so, when the drum 32 is viewed from the front, circulating water is sprayed in a manner of passing through an area higher than the center C of the drum 32 at the entrance hole of the drum 32 and traveling in a direction inclined downward toward an area deep inside the drum 32.

The pair of the lower nozzles 650*b* and 650*d* is disposed higher than the inlet port 73 but lower than the pair of the upper nozzles 650*a* and 650*c*. The pair of the lower nozzles 650*b* and 650*d* may be disposed on the left and right sides with reference to the inlet port 73, respectively. Preferably, the pair of the lower nozzles 650*b* and 650*d* are disposed symmetrical about the reference line so that spray directions of the respective lower nozzles 650*b* and 650*d* are symmetrical about the reference line L.

The pair of the lower nozzles 650*b* and 650*d* may be disposed lower than the center O or the center C of the drum 32. The respective lower nozzles 650*b* and 650*d* spray circulating water upward, so, when the drum 32 is viewed from the front, circulating water is sprayed in a manner of passing through an area lower than the center C of the drum 32 at the entrance hole of the drum 32 and traveling in a direction inclined upward toward an area deep inside the drum 32.

Taken an example of the first nozzle 650*a*. One end of the nozzle conduit 651 communicates with the first port receiving pipe 641, and the other end thereof is open inside the tub 31. One end of the nozzle conduit 651 has a sectional area smaller than that of the other end. A through hole 651*a* is formed inside the nozzle conduit 651.

The nozzle head 652 interferes with sprayed circulating water and changes a spray direction of the circulating water. The nozzle head 652 sprays the circulating water toward an inner portion of the rear side of the tub 32.

The other end 653 of the nozzle head 652 is spaced apart from a discharge side (the other side) of the nozzle conduit 651. Spaced apart from the other end of the nozzle conduit 651, the nozzle head 652 is disposed to hide the nozzle conduit 651. Circulating water hits an inner surface of the nozzle head 652, thereby changing a direction to be discharged. The other end 653 of the nozzle head 652 is disposed to face the rear of the tub 31.

Circulating water discharged through a discharge hole 651*c* of the nozzle conduit 651 hits the collision surface 652*a* of the nozzle head and is then sprayed into the tub 31 through the spray hole 657. A direction in which the spray hole 657 faces intersect with a direction in which the nozzle conduit 651 extends.

The distribution pipe 701 includes the inlet port 71 connected to a circulation pipe 18, a transport conduit 74 guiding water introduced through the inlet port 73, and a plurality of outlet ports 761, 762, 763, and 764 protruding from the transport conduit 74.

The distribution pipes 701 may be formed of synthetic resin that is harder or stiffer than the gasket 60. The distribution pipes 701 maintains a predetermined shape in spite of vibration occurring during operation of the washing machine, and the distribution pipes 701 is relatively rigid compared to the gasket 60, which transforms in response to vibration of the tub 31. The same description apply to a first distribution pipe 701 and a second distribution pipe 703 which are described in the following.

The distribution pipe 701 branches circulating water discharged from the circulation pipe 18 to thereby form a first sub-flow FL1 (see FIG. 13) and a second sub-flow FL2 (see FIG. 13). In the distribution pipe 701, at least one outlet port 762 or 763 is formed in a first flow path through which the first sub-flow FL1 is guided, so that circulating water is discharged through a corresponding outlet port 762 or 763 toward a corresponding nozzle 650*b* or 650*c*. Likewise, at least one outlet port 764 or 72*e* is formed in a second flow path through which the second sub-flow FL2 is guided, so that circulating water is discharged through a corresponding outlet port 764 or 72*e* toward a corresponding nozzle 650*d*. The transfer conduit 74 may include a first conduit 75 forming the first flow path, and a second conduit 76 forming the second flow path.

One end of the first conduit 75 and one end of the second conduit 76 are connected to each other, and the inlet port 73 protrudes in the connected portion. However, the other end of the first conduit 75 and the other end of the second conduit 76 are separated from each other. That is, the transport conduit 74 generally has a "Y" shape to thereby branch circulating water introduced through one entrance hole (that is, the inlet port 73) into two flow paths.

The nozzles 650*a*, 650*b*, 650*c*, and 650*d* may be classified as the upper nozzles 650*a* and 650*c* and the lower nozzles 650*b* and 650*d* by heights thereof on the gasket 60. In the present embodiment, four nozzles 650*a*, 650*b*, 650*c*, and 650*d* are provided. The four nozzles 650*a*, 650*b*, 650*c*, and 650*d* may include the first lower nozzle 650*b* and the second lower nozzle 650*d* disposed in the lower part of the gasket 60, and the first upper nozzle 650*a* and the second upper nozzle 650*c*, which are disposed higher than the lower nozzles 650*b* and 650*d*.

The outlet ports 761, 762, 763, and 764 are provided in a number corresponding to the number of the nozzles 650*a*, 650*b*, 650*c*, and 650*d*, and each of the outlet ports 761, 762, 763, and 764 supplies circulating water to a corresponding nozzle in the nozzles 650*a*, 650*b*, 650*c*, and 650*d*.

The outlet ports 761, 762, 763, and 764 may include a first upper outlet port 761 supplying circulating water to the first upper nozzle 650*a*, a second upper outlet port 762 supplying circulating water to the second upper nozzle 650*c*, a first lower outlet port 763 supplying circulating water to the first lower nozzle 650*b*, and a second lower outlet port 764 supplying circulating water to the second lower nozzle 650*d*.

The transport conduit 74 is disposed in a circumference of the outer circumferential part of the gasket 60, and connected to a pump 901 via the circulation pipe 18. The respective outlet ports 761, 762, 763, 764 protrudes inwardly from the transport conduit 74 along a radial direction and are inserted into the gasket 60 to thereby supply circulating water to the corresponding nozzles 650*a*, 650*b*, 650*c*, and 650*d*.

The distribution pipe 701 may include the inlet port 73 that protrudes from the transport conduit 74 to be connected to the circulation pipe 18. The inlet port 73 may protrude outwardly from the transport conduit 74 along the radial direction.

Referring to FIG. 11, the first conduit 75 may include a first section 751, a second section 752, a third section 753, and a fourth section 754. The second conduit 76 has a shape symmetrical to the first conduit 75 and have the configuration substantially identical to that of the first conduit 75. Therefore, the following description about the first conduit 75 may apply even to the second conduit 76.

The first section 751 extends from the inlet port 73. The first section 751 is an arc-shaped section that extends at a predetermined curvature. In the present embodiment, the first section 751 is a curved line having an approximately predetermined curvature, but aspects of the present invention are not limited thereto. In some embodiments, the first section 751 may be in a shape in which two or more curved lines having different curvatures are connected.

The second section 752 may continue from the first section 751 and have a shape spreading outwardly from the first section 751. In other words, the second section 752 corresponds to a portion that is bent outwardly (that is, a direction distal from the center O) from the top end of the first section 751 and extends by a distance L2. The length L2 of the second section 752 may be shorter than a length L1 of the first section 751.

The third section 753 is a portion that is bent inwardly (that is, a direction proximal to the center O) from the second section 752 and extends by a distance L3. The third section 753 may extend substantially vertically upward from the second section 752. The lower outlet port 762 may be formed in the third section 753 and extend in a horizontal direction (or a direction orthogonal to the second section 752).

In the third section 753, a surface 750*b* where the lower outlet port 762 protrudes may be formed flat. The surface 750*b* may extend in the vertical direction. At least a portion of the surface 750*b* may be brought into contact with the outer surface of the gasket body 63. Further, an end portion of the second port receiving pipe 642 may be tightly brought into contact with the surface 750*b*.

The fourth section 754 is bent inwardly (that is, in a direction proximal to the enter O) from the third section 753 and further extends by a distance L4 to thereby reach an end portion of the first conduit 75. The upper outlet port 761 may be formed in the fourth section 754 and preferably at an end portion of the fourth section 754 as shown in the present embodiment. The fourth section 754 may be in the shape of a curved line having a predetermined curvature, and may extend in a direction intersecting with a length direction of the upper outlet port 761.

At an end portion of the first conduit 75 (or an end portion of the fourth section 754, a surface 750*a* where the upper outlet port 761 protrudes may be formed flat. The surface 750*a* may extend in the vertical direction. In this case, the surface 750*b* and the surface 750*a* are parallel to each other. At least a portion of the surface 750*a* may be brought into contact with an end portion of the first port receiving pipe 641. At least a portion of the surface 750*b* may be brought into contact with an end portion of the second port receiving pipe 642.

Meanwhile, since the fourth section 754 is in the shape bent inwardly from the third section 753, the surface 750*a* where the upper outlet port 761 is formed is, when viewed from the front, disposed closer to the symmetry reference line L than the surface 750*b* where the lower outlet port 762 is formed. Further, it is preferable that the surface 750*a* is closer to the outer surface of the gasket body 63 than the surface 750*b*.

In addition, when viewed from the front, an end portion of the first outlet port 761 is disposed at a location closer by a distance S to the symmetry reference line L than an end portion of the second outlet port 762.

Referring to FIGS. 11 and 12, a first port connection part 757 may be formed at a portion connected to the first outlet port 761, and a second port connection part 758 may be formed at a portion connected to the second outlet port 762.

Likewise, in the second conduit 760, a third port connection part 767 may be formed at a portion connected to the third outlet port 763, and a fourth port connection part 768 may be formed at a portion connected to the fourth outlet port 764.

When viewed from the front, the respective port connection parts 757, 758, 767, and 768 may be in the shape that is convex further forward compared to a surrounding area. A width P of each of the port connection parts 757, 758, 767, and 768 may be greater than a width W of the surrounding portions. In other words, the conduits 75 and 76 may extend from the inlet port 73 with a constant width W, protrude forward convexly, and is then reduced in width to thereby extend to the port connection part 757 with the width W. Meanwhile, the width P of the port connection parts 757, 758, 767, and 768 may be greater than a diameter t of the outlet port 761.

Referring to FIGS. 14 to 16, a ring-type press-fit protrusion 769 extending in a circumferential surface may be formed on the outer surface of each of the outlet ports 761, 762, 763, and 764. The press-fit protrusion 769 may be provided in plural along the length direction of each of the outlet ports 761, 762, 763, and 764. The press-fit protrusion 769 may have a wedge-shaped cross section. When the first outlet port 761 is inserted into the first port receiving pipe 641, the press-fit protrusion 769 presses the inner circumferential surface of the port receiving pipe 641 to thereby increase a coupling force.

If a direction in which the outlet port 761 is inserted into the port receiving pipe 641 is defined as a first direction, the press-fit protrusion 769 may include a vertical surface and a slope surface that is inclined so that a height thereof is gradually reduced from the vertical surface toward the first direction. When the outlet port 761 is inserted into the port receiving pipe 641, press fitting is enabled easily due to the slope surface. After the press fitting is completed, the outlet port 761 is not allowed to be separated from the port receiving pipe 641 easily due to the vertical surface. The distribution pipe 701 is capable of being coupled to the gasket 60 without using a binding member (e.g., a clamp), and thus, a work time for screwing the binding member is not required Meanwhile, while the outlet ports 761, 762, 763, and 764 are inserted into the port receiving pipes 641, 642, 643, and 644, an end portion of each of the outlet ports 761, 762, 763, and 764 is able to reach the nozzle conduit 651. At this point, the inner circumferential surface of each of the outlet ports 761, 762, 763, and 764 and the inner circumferential surface of the conduit 651 forms a substantially continuing surface, thereby reducing resistance of circulating water. The nozzle conduit 651 has an annular shape, protrudes from the inner circumferential surface of the outer circumferential portion 632, and is connected to a corresponding nozzle head 652.

Figure 18:
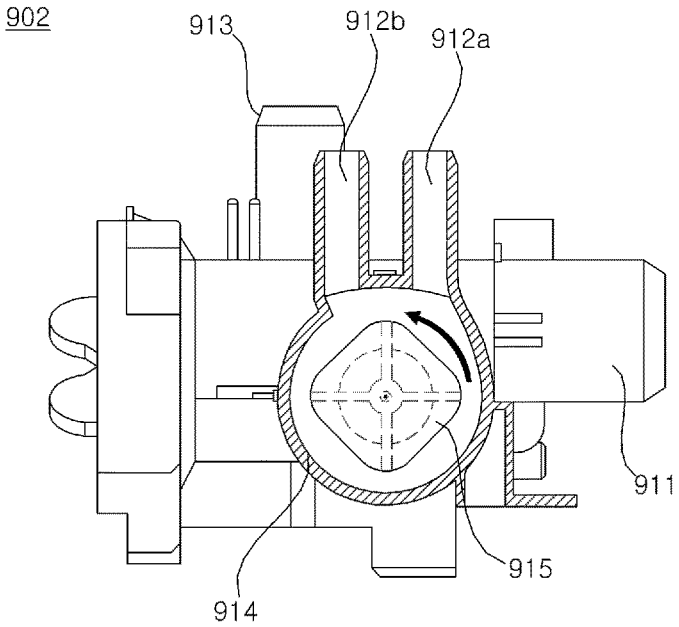
FIG. 18 is a perspective view of a pump according to another embodiment of the present invention.
Figure 19:
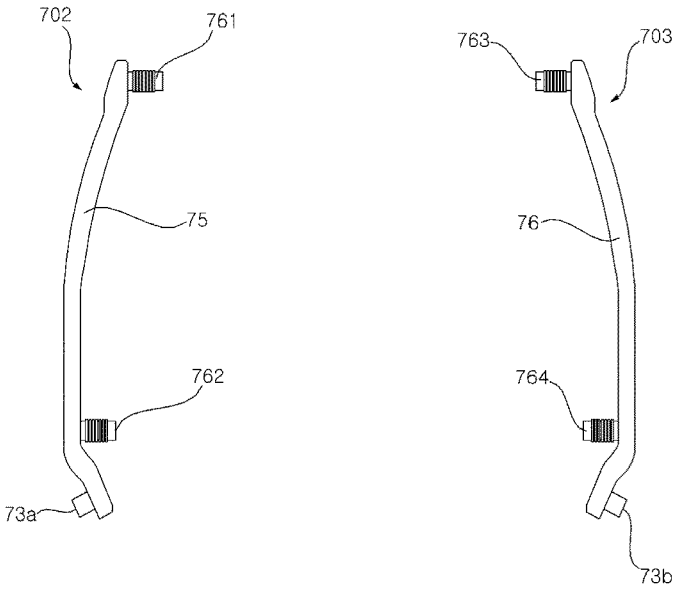
FIG. 19 illustrates a distribution pipe according to another embodiment of the present invention.

FIG. 18 is a perspective view of a pump according to another embodiment of the present invention. FIG. 19 illustrates a distribution pipe according to another embodiment of the present invention. Unlike the above-described embodiment, two distribution pipes 702 and 703 may be installed in the gasket 60. The two distribution pipes 702 and 703 may include a first distribution pipe 702 disposed on one side of the reference line L, and a second distribution pipe 703 disposed on the other side of the reference line L.

There is provided a pump 902 for supplying circulating water to the two distribution pipes 702 and 703. The pump 902 may include two circulation ports 912*a* and 912*b*. Although not illustrated in the drawings, two circulation pipes connect the circulation ports 812*a* and 912*b* to the distribution pipes 702 and 703, respectively.

More particularly, the pump 902 includes a pump housing 91, an impeller 915 disposed in the pump housing 915, and a pump motor 92 configured to provide a torque to rotate the impeller 915.

The pump housing 91 forms a chamber where the impeller 915 is housed. The pump housing 91 includes an inlet port 911 connected to a drain bellows 17 to guide circulating water into the chamber, and a first circulation port 912 and a second circulation port 912*b* for discharging water pumped by the impeller 915.

A water current formed upon rotation of the impeller 815 by the pump motor 92 is discharged through the first circulation port 912*a* and the second circulation port 912*b* at the same time. In this case, water discharged through the first circulation port 912*a* is supplied to the first distribution pipe 702 through a first circulation pipe (not shown), and water discharged through the second circulation port 912*b* is supplied to the second distribution pipe 703 through a second circulation pipe (not shown).

The first distribution pipe 912*a* supplies circulating water to a first nozzle 650*a* and a second nozzle 650*b*. The first distribution pipe 912*a* may include a first inlet port 73*a* connected to the first circulation port 912*a* through the first circulation pipe, a first conduit 75 guiding circulating water introduced through the first inlet port 73*a*, and two outlet ports 761 and 762 disposed in the first conduit 75.

The two outlet ports 761 and 762 may be inserted into a first port receiving pipe 641 and a second port receiving pipe 642, respectively.

The second distribution pipe 703 supplies circulating water to the third nozzle 650*c* and the fourth nozzle 650*d*. The second distribution pipe 703 may include a second inlet port 73*b* connected to the second circulation port 912*b* by the second circulation pipe, a second conduit 76 guiding circulating water introduced through the second inlet port 73*b*, and two outlet ports 763 and 764 disposed in the second conduit 76.

The two outlet ports 763 and 764 may be inserted into the third port receiving pipe 643 and the fourth port receiving pipe 644, respectively.

Meanwhile, the pump housing 91 may further include a drain port 913 connected to the drain pipe 19. Like the above-described embodiment, the pump 901 may further include a chamber 916 into which circulating water is introduced through the inlet port 911 and which communicates with the drain port 913, an impeller 917 rotating in the chamber 916, and a second pump motor 93 rotating the impeller 917 (see FIGS. 5 and 6).

Although some embodiments have been described above, it should be understood that the present invention is not limited to these embodiments, and that various modifications, changes, alterations and variations can be made by those skilled in the art without departing from the spirit and scope of the invention. Therefore, it should be understood that the above embodiments are provided for illustration only and are not to be construed in any way as limiting the present invention.

What is claimed is:

1. A washing machine comprising:

a casing that defines an entry hole at a front surface of the casing;

a tub disposed in the casing and configured to receive wash water, the tub defining a tub opening at a front surface of the tub;

a drum rotatably disposed in the tub;

a gasket comprising:

a gasket body that defines a passage connecting the entry hole to the tub opening, wherein the gasket body includes a first area and a second area that correspond to bilateral areas of the gasket body, and a plurality of port receiving pipes that protrude from an outer circumferential surface of the gasket body, the plurality of port receiving pipes including (i) a first port receiving pipe disposed vertically above a horizontal line passing through a center of the gasket body and (ii) a second port receiving pipe disposed vertically below the horizontal line;

a plurality of nozzles that are disposed at an inner circumference of the gasket body, the plurality of nozzles including a first nozzle and a second nozzle that are arranged in a vertical direction at the first area of the gasket body and that are in fluid communication with the first port receiving pipe and the second port receiving pipe, respectively;

a pump configured to circulate wash water discharged from the tub; and a distribution pipe configured to receive wash water discharged from the pump and to supply received wash water to the first nozzle and the second nozzle, the distribution pipe including a first outlet port and a second outlet port that are inserted into the first port receiving pipe and the second port receiving pipe, respectively, wherein a length of the second port receiving pipe is less than a length of the first port receiving pipe.

2. The washing machine of claim 1, wherein the first nozzle is configured to spray a first water stream downward to the drum, and wherein the second nozzle is configured to spray a second water stream upward to the drum.

3. The washing machine of claim 2, wherein the first nozzle and the second nozzle are configured to spray wash water toward the second area of the gasket body facing the first area of the gasket body.

4. The washing machine of claim 3, wherein the plurality of nozzles further comprise a third nozzle and a fourth nozzle that are disposed at an inner circumferential surface of the gasket body and that are arranged in the vertical direction at the second area of the gasket body.

5. The washing machine of claim 4, wherein the third nozzle and the fourth nozzle are configured to spray water toward the first area of the gasket body.

6. The washing machine of claim 5, wherein the first nozzle is configured to spray the first water stream in a first direction laterally symmetrical with a third water stream sprayed through the third nozzle, and wherein the second nozzle is configured to spray the second water stream in a second direction laterally symmetrical with a fourth water stream sprayed through the fourth nozzle.

7. The washing machine of claim 2, wherein the first water stream has a first spray width angle, and wherein the second water stream has a second spray width angle that is greater than the first spray width angle.

8. The washing machine of claim 7, wherein a difference between the second spray width angle and the first spray width angle is between 4° and 6°.

9. The washing machine of claim 8, wherein the first spray width angle is between 38° and 42°.

10. The washing machine of claim 2, wherein the first nozzle is configured to spray wash water toward a region of the drum above the center of the gasket body.

11. The washing machine of claim 2, wherein the first nozzle is configured to spray wash water in a spray direction, the spray direction defining a deviation angle about the first nozzle relative to a line that extends from the first nozzle to the center of the gasket body.

12. The washing machine of claim 11, wherein the deviation angle is between 5° and 9°.

13. The washing machine of claim 2, wherein the second nozzle is disposed at a lower position that defines a first angle with respect to the lowest point of the gasket body about the center of the gasket body, wherein the first nozzle is disposed at an upper position between the second nozzle and a highest point of the gasket body, the upper position defining a second angle with respect to the highest point of the gasket body about the center of the gasket body, wherein the second angle is less than a half of a difference between 180° and the first angle, and wherein the first nozzle is disposed closer to the highest point of the gasket body than to the second nozzle.

14. The washing machine of claim 2, wherein a first angle defined between the first nozzle and the second nozzle about the center of the gasket body is greater than a second angle defined between a highest point of the gasket body and the first nozzle about the center of the gasket body.

15. The washing machine of claim 14, wherein the first angle is between 63° and 67°.

16. The washing machine of claim 2, wherein the second nozzle is disposed at a region corresponding to one third of a height of the gasket body.

17. The washing machine of claim 16, wherein the first nozzle is disposed vertically above a point corresponding to two thirds of the height of the gasket body.

18. The washing machine of claim 1, wherein the plurality of port receiving pipes further comprise a third port receiving pipe and a fourth port receiving pipe that are arranged in the vertical direction at the second area of the gasket body facing the first area of the gasket body, and wherein the plurality of nozzles further comprise a third nozzle and a fourth nozzle that are disposed at an inner circumferential surface of the gasket body and that are arranged in the vertical direction at the second area of the gasket body.

19. The washing machine of claim 1, wherein the first port receiving pipe is disposed vertically above a middle height point of the gasket body, wherein the second port receiving pipe is disposed vertically below the middle height point of the gasket body, and wherein a first distance between the first port receiving pipe and the middle height point of the gasket body is greater than a second distance between the second port receiving pipe and the middle height point of the gasket body.

20. The washing machine of claim 19, wherein a first horizontal distance between a first end of the first port receiving pipe and a vertical line passing through the center of the gasket body is less than a second horizontal distance between a second end of the second port receiving pipe and the vertical line.

* * * * *